US011086257B2

(12) United States Patent
Sasaoka

(10) Patent No.: US 11,086,257 B2
(45) Date of Patent: Aug. 10, 2021

(54) SENSOR UNIT AND IMAGE FORMING APPARATUS

(71) Applicant: CANON KABUSHIKI KAISHA, Tokyo (JP)

(72) Inventor: Osamu Sasaoka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/797,932

(22) Filed: Feb. 21, 2020

(65) Prior Publication Data

US 2020/0272076 A1 Aug. 27, 2020

(30) Foreign Application Priority Data

Feb. 25, 2019 (JP) ..... JP2019-032128
Feb. 7, 2020 (JP) ..... JP2020-020190

(51) Int. Cl.

| | |
|---|---|
| ***G03G 15/20*** | (2006.01) |
| ***G03G 21/16*** | (2006.01) |
| ***G03G 15/00*** | (2006.01) |
| ***B41J 11/00*** | (2006.01) |

(52) U.S. Cl.

CPC ..... *G03G 15/2035* (2013.01); *B41J 11/006* (2013.01); *G03G 15/5012* (2013.01); *G03G 15/70* (2013.01); *G03G 21/1638* (2013.01); *G03G 2215/00548* (2013.01)

(58) Field of Classification Search

CPC ..... G03G 15/70; G03G 15/2035; G03G 15/5012; G03G 21/1638; G03G 2215/00548; B41J 11/006

See application file for complete search history.

(56) References Cited

U.S. PATENT DOCUMENTS

| | | | | |
|---|---|---|---|---|
| 2012/0063791 | A1* | 3/2012 | Iwanaga | B41J 11/006 399/21 |
| 2015/0036157 | A1* | 2/2015 | Takahashi | G03G 21/1652 358/1.12 |
| 2018/0164734 | A1* | 6/2018 | Saito | G03G 15/2035 |

FOREIGN PATENT DOCUMENTS

| | | | |
|---|---|---|---|
| JP | 06-258893 | A | 9/1994 |
| JP | 08-328406 | A | 12/1996 |
| JP | 2005-250324 | A | 9/2005 |
| JP | 2006-227464 | A | 8/2006 |

* cited by examiner

*Primary Examiner* — Joseph S Wong
(74) *Attorney, Agent, or Firm* — Venable LLP

(57) ABSTRACT

A sensor unit includes a first movable member including a member-to-be-detected, a sensor, and a second movable member. When a sheet is normally fed, the first movable member is in a first position, the member-to-be-detected is in a first phase, the second movable member is in a second position, and a functional/non-functional state of the member-to-be-detected is one state. When the sheet is not fed and the first movable member is in a second position, the member-to-be-detected is in the first phase, the second movable member is in a third position, and the functional/non-functional state is the other state. When the first movable member is in the first position and the second movable member is in a fourth position, by movement of the member-to-be-detected to a second phase, the functional/non-functional state is changed from the one state to the other state and an output of the sensor changes.

6 Claims, 16 Drawing Sheets

(a)

(b)

(a)

(b)

SENSOR UNIT AND IMAGE FORMING APPARATUS

FIELD OF THE INVENTION AND RELATED ART

The present invention relates to a sensor unit for detecting a jam of a sheet and an image forming apparatus including the sensor unit.

A copying machine and a printer which include an image forming mechanism of an electrophotographic type include a fixing unit for fixing an image on a sheet. In such a fixing unit, the sheet on which a toner image is transferred is nipped and fed in a nip between a pressing member and a heating to member and thus is heated and pressed, so that toner (image) is fixed on the sheet.

Such a fixing unit is provided with a sensor for detecting an occurrence of a sheet jam in a feeding passage, i.e., an occurrence of a so-called jam. In the case where the jam occurred inside the fixing unit, pressure applied to the nip is released (in a sense inclusive of pressure reduction), to provide an advantage such that the sheet is easily removed.

It has been known that an eccentric cam is used as a mechanism for releasing (eliminating) pressure applied to the nip (Japanese Laid-Open Patent Application Hei 8-328406). In the case where the eccentric cam is operated in such a manner, there is a need to accurately discriminate whether the pressing member and the heating member are in a pressed state or in a pressure-released state. Therefore, in the fixing unit, a sensor for detecting a rotational phase of the eccentric cam is also mounted.

Incidentally, in addition to the above-described sensors, in the image forming apparatus, various sensors, such as a sensor for detecting timing of sheet feeding and a sensor for detecting opening/closing of a door portion of a frame, in order to detect various behaviors of devices are provided. However, in the case where the sensor is provided for each behavior of an object to be detected, many sensors are required to be mounted in the image forming apparatus, so that a problem such that increases in size and cost cannot be avoided can arise.

SUMMARY OF THE INVENTION

A principal object of the present invention is to provide a sensor unit capable of detecting a plurality of behaviors of devices in order to solve the above-described problem and to provide an image forming apparatus including the sensor unit.

According to an aspect of the present invention, there is provided a sensor unit for detecting a jam of a sheet, comprising: a rotatable first movable member; a sensor configured to detect a position of the first movable member; and a second movable member having a guiding function of guiding movement of the sheet, wherein the first movable member includes a member-to-be-detected configured to be detected by the sensor and an urging member configured to urge the member-to-be-detected toward a position in which a phase of the member-to-be-detected relative to the first movable member is a first phase, wherein when the sheet is normally fed along the second movable member, the first movable member is in a first position, the member-to-be-detected is in the first phase, the second movable member is in a third position, and a functional/non-functional state of the member-to-be-detected relative to the sensor is one of functional and non-functional states, wherein when the sheet is not fed and the first movable member is in a second position different in rotational direction from the first position, the member-to-be-detected is in the first phase, the second movable member is in the third position, and the functional/non-functional state of the member-to-be-detected relative to the sensor is the other one of the functional and non-functional states, and wherein when the first movable member is in the first position and the second movable member is moved to a fourth position different from the third position by being pushed by a jammed sheet, by movement of the member-to-be-detected to a second phase different from the first phase through pushing thereof by the second movable member, the functional/non-functional state of the member-to-be-detected relative to the sensor is changed from the one state to the other state and an output of the sensor changes.

Further features of the present invention will become apparent from the following description of exemplary embodiments with reference to the attached drawings.

DESCRIPTION OF EMBODIMENTS

First Embodiment

Figure 1:
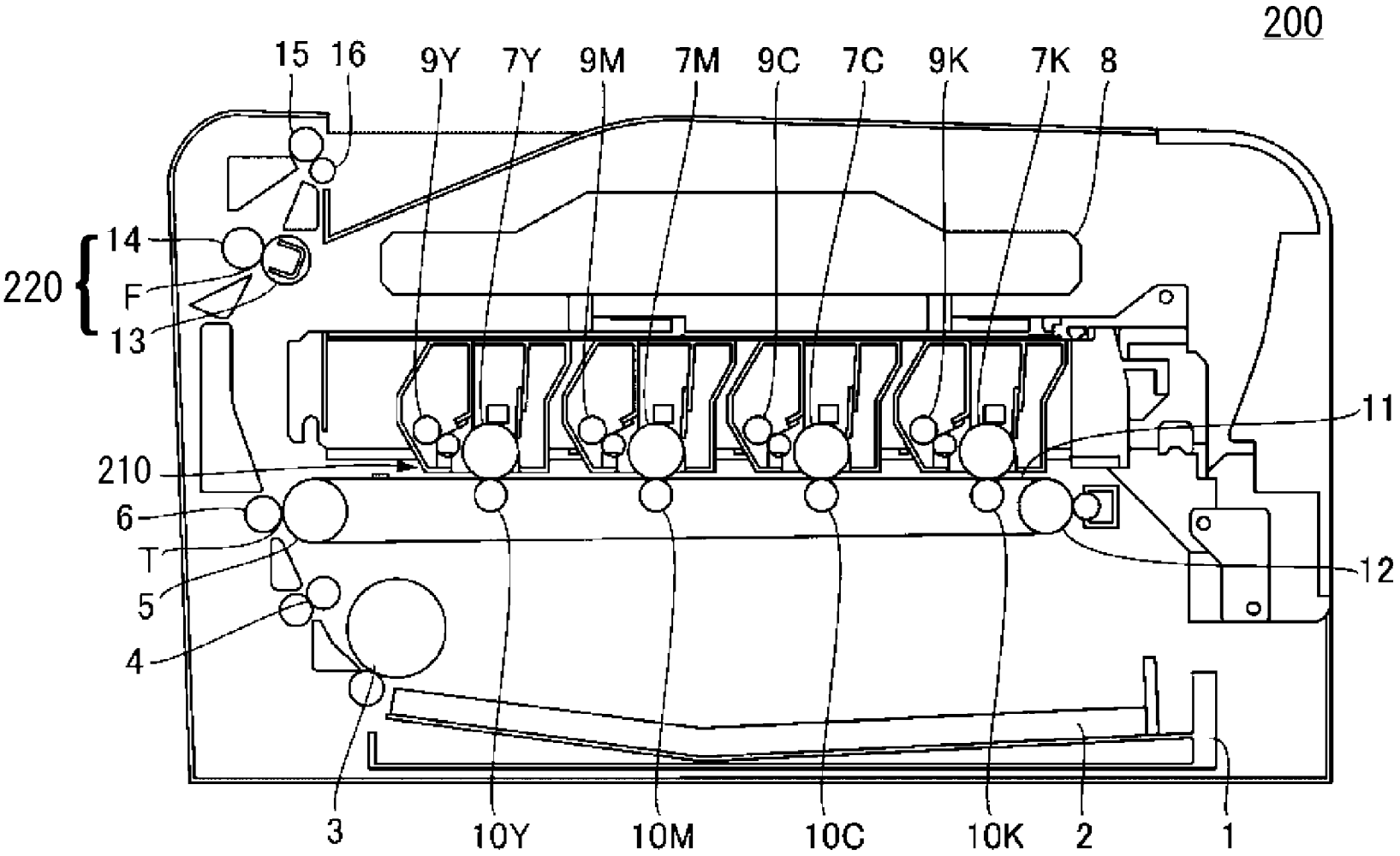
FIG. 1 is a schematic sectional view of an image forming apparatus according to a first embodiment of the present invention.

First, an image forming apparatus including a sensor unit 100 according to a first embodiment will be described. FIG. 1 is a schematic sectional view a full-color laser beam printer 200 as the image forming apparatus including the sensor unit 100 according to the first embodiment. As shown in FIG. 1, in the printer 200, a controller 110 (FIG. 5) for controlling an operation of an entirety of the printer 200 and an image forming portion 210 as an image forming means for forming an image on a sheet 2 are provided.

A constitution of a feeding passage of the sheet 2 in the printer 200 will be described. In the printer 200, a feeding tray 1, a feeding roller 3, a conveying roller 4, a discharging roller 15 and a discharging roller 16 are provided. The sheet 2 accommodated in a feeding tray 1 is fed toward the conveying roller 4 by the feeding roller 3 and then is conveyed by the conveying roller 4 to a transfer nip T formed by an inner belt driving roller 5 and a secondary transfer roller 6. Onto the sheet 2, at the transfer nip T, the image formed by the image forming portion 210 is transferred.

Next, a constitution of the image forming portion 210 will be described. The image forming portion 210 includes the inner belt driving roller 5, the secondary transfer roller 6, a laser scanner 8, photosensitive drums 7Y, 7M, 7C and 7K, and developing rollers 9Y, 9M, 9C and 9K. The image forming portion 210 further includes primary transfer units 10Y, 10M, 10C and 10K, an intermediary transfer belt 11 and a tension roller 12. The image forming portion 210 is of a full-color type using the four photosensitive drums, so that toner images of yellow (Y), magenta (M), cyan (C) and black (K) can be formed.

In the image forming portion 210, outer peripheral surfaces of the photosensitive drums 7Y, 7M, 7C and 7K are irradiated with laser light from the laser scanner 8, so that electrostatic latent images are formed for respective colors. These electrostatic latent images are developed with toners of Y, M, C and K supplied by the developing rollers 9Y, 9M, 9C and 9K, so that the toner images are formed on the photosensitive drums 7Y, 7M, 7C and 7K, respectively. The toner images formed on the photosensitive drums 7Y, 7M, 7C and 7K are transferred onto the intermediary transfer belt 11 by being pressed under application of a transfer bias by the primary transfer units 10Y, 10M, 10C and 10K. The intermediary transfer belt 11 is wound around the inner driving roller 5 and the tension roller 12, and is rotated clockwise in FIG. 1 by the inner belt driving roller 5 driven by an unshown driving portion.

Incidentally, the intermediary transfer belt 11 is moved at the substantially same speed as a movement speed of surfaces of the photosensitive drums 7Y, 7M, 7C and 7K by the inner belt driving roller 5. Then, the respective color toner images formed on the photosensitive drums 7Y, 7M, 7C and 7K are successively transferred onto the intermediary transfer belt 11 by the primary transfer rollers 10Y, 10M, 10C and 10K. Thus, the color images of the respective color toners are formed on the intermediary transfer belt 11. The toner images formed on the intermediary transfer belt 11 are collectively transferred onto the sheet 2 in the transfer nip T between the inner belt driving roller 5 and the secondary transfer roller 6. On a side downstream of this transfer nip T with respect to a feeding direction of the sheet 2, a fixing unit 220 including a heating unit 13 and a pressing roller 14 are provided.

The sheet 2 on which the toner images are transferred at the transfer nip T is fed to a fixing nip F formed by the heating unit 13 and the pressing roller 14. Then, in the fixing nip F, the sheet 2 is nipped by the heating unit 13 and the pressing roller 14 and thus is heated and pressed. The toners are melted by heating and pressing and are fixed on the sheet 2. In the fixing nip F, the toner images are thus fixed on the sheet 2. The sheet 2 on which the toner images are fixed is discharged to an outside of a casing of the printer 200 by discharging rollers 15 and 16.

Incidentally, the image forming portion 210 is an example of an image forming means capable of forming an image on the sheet as a recording material (medium), and as a constitution of a type other than the above-described intermediary transfer type including the intermediary transfer member, a constitution of a direct transfer type may also be used, and other image forming mechanisms of types such as an ink jet type may also be used. Further, a constitution in which the printer 200 is provided with a reversing roller pair capable of normal and reverse rotation and a re-feeding passage and in which the sheet 2 on which the image is formed on one side (for example, a front surface) is fed again to the image forming portion 210 and image formation on both (double) sides of the sheet 2 is executable may also be employed.

Next, the fixing unit 220 in this embodiment will be described.

Figure 2:
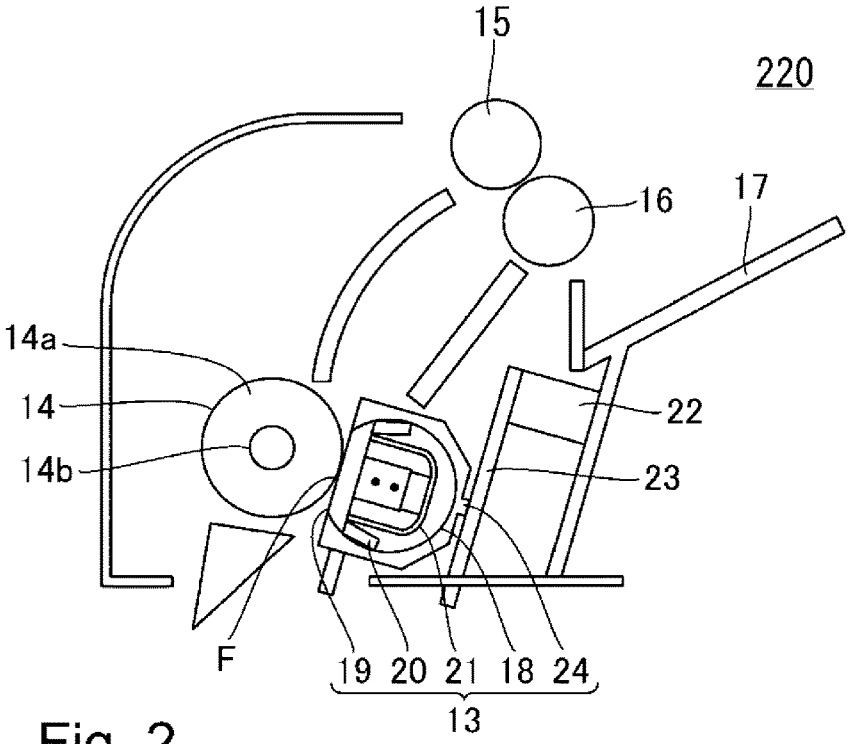
FIG. 2 is a schematic sectional view of a fixing means in the first embodiment.

FIG. 2 is a schematic structural view showing a principal part of the fixing unit 220. The fixing unit 220 includes the heating unit (first nip forming member) 13, the pressing roller (second nip forming member) 14, a sensor unit 100 (FIG. 3), a pressing spring 22, a pressing plate 23 and a force receiving block 24. The heating unit 13 includes a cylindrical fixing film 18, a heater 19 which contacts an inner surface of the fixing film 18 and which heats the fixing film 18, a holder 20 having a heat-resistant property, and a stay 21 having rigidity. The fixing film 18 is, for example, a thin cylindrical plastic film having a high heat-resistant property and a high heat-conductive property. The heater 19 is, for example, a ceramic heater or a carbon heater and is a heat source which generates heat through energization by an unshown power source. Further, the heater 19 is supported in a state in which the heater is engaged and fixed in a groove portion of the holder 20. The fixing film 18 is mounted in a state of covering an outer periphery of the heater 19, the holder 20 and the stay 21, so that rotational motion of the fixing film 18 is enabled.

The heating unit 13 is configured so as to be contactable to the pressing roller 14 (so as to be capable of forming the fixing nip F) by receiving a force of the pressing spring 22 through the pressing plate 23 and the force receiving block 24. The pressing roller 14 includes a core metal 14*a* and a rubber layer 14*b* formed in a roller shape at an outer periphery of the core metal 14*a*. Accordingly, the surface of the pressing roller 14 has elasticity, and therefore, the heating unit 13 and the pressing roller 14 form the fixing nip F having a predetermined width and are provided so as to be press-contactable to each other at predetermined pressure.

Further, in this embodiment, when the pressing spring 22 is contracted, the heating unit 13 and the pressing roller 14 are in a pressure released state (separated state). On the other hand, when the pressing spring 22 is expanded (extended), the heating unit 13 and the pressing roller 14 are in a pressed state (contact state in which the fixing nip F suitable for fixing is formed). The pressing roller 14 is rotationally driven at a predetermined peripheral speed by a pressing roller rotating motor 140 (FIG. 5) in a state in which the pressing roller 14 contacts the heating unit 13. Then, by rotation of the pressing roller 14, a frictional force generates between the fixing film 18 and the pressing roller 14. By this frictional force, the fixing film 18 performs rotational motion by rotation of the pressing roller 14. The pressing roller 14 and the fixing film 18 are rotated while the heater 19 is energized and heated, so that the sheet 2 on which unfixed toner images are carried is conveyed to the fixing nip F between the fixing film 18 and the pressing roller 14. Then, as described above, in the fixing nip F, the toner images are fixed on the sheet 2.

After the toner images are fixed on the sheet 2, the sheet 2 is curvature-separated and is conveyed from the fixing nip F toward a side downstream of the fixing nip F with respect to the sheet feeding direction.

Figure 3:
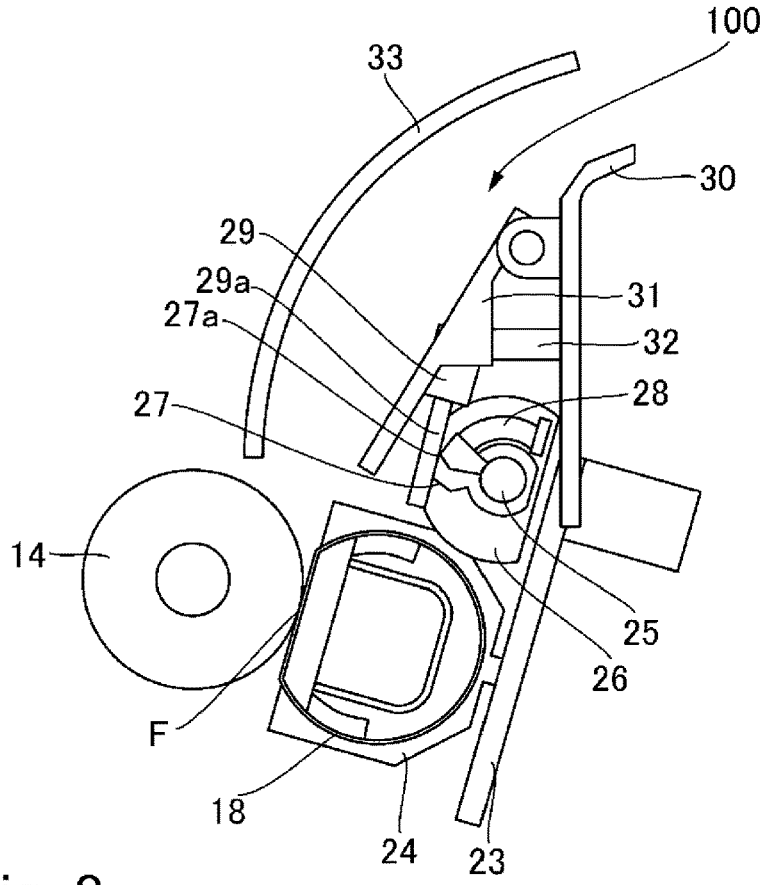
FIG. 3 is a schematic sectional view of a neighborhood of a fixing nip in the first embodiment.

At this time, the sheet 2 is guided to a nip between the discharging rollers 15 and 16 by a guiding member such as a detection guide 31 (FIG. 3). The sheet 2 guided to the nip is conveyed in a state in which the sheet 2 is nipped by the discharging rollers 15 and 16 and is discharged on a sheet discharge/stack table 17. Incidentally, as a constitution of the heating unit 13 and the pressing roller 14, a constitution in which a heat source is provided inside a rotatable member pair such as rollers and the toner images are fixed on the sheet 2 by heating the sheet 2 in a state in which the sheet 2 is nipped between the rotatable member pair may also be employed.

Next, a constitution of the sensor unit 100 in this embodiment will be described with reference to FIG. 3. FIG. 3 is a sectional view of the fixing unit 220 in which the sensor unit 100 according to this embodiment is provided. The sensor unit 100 includes a rotation shaft 25, a pressure releasing cam (first movable member) 26, a flap-to-be-detected (flag-to-be-detected, member-to-be-detected) 27, a flag spring (urging member) 28, a pressure releasing sensor 29, a lever portion 29*a* which is a part of the pressure releasing sensor 29 and which acts on the flag spring 28, and a detection guide (second movable member) 31. As shown in FIG. 3, the rotation shaft 25 is disposed in the neighborhood of the pressing plate 23, and the pressure releasing cam 26 is a rotatable member rotatable about the rotation shaft 25. The pressure releasing cam 26 is a first movable member in this embodiment. FIG. 3 also shows a state when the sheet 2 is normally conveyed along the detection guide 31.

The pressure releasing cam 26 is provided with the flap-to-be-detected 27. The flap-to-be-detected 27 is supported by the pressure releasing cam 26 in a mechanical play state so that the flap-to-be-detected 27 is movable about the rotation shaft 25 in a rotational direction of the pressure releasing cam 26. By this play, the flap-to-be-detected 27 is movable relative to the pressure releasing cam 26 and is capable of moving to at least two positions (a position (first phase) of part (a) of FIG. 4 and a position (second phase) of part (b) of FIG. 4).

Further, the flap-to-be-detected 27 is provided rotatably together with the pressure releasing cam 26 while unchanging a position thereof relative to the pressure releasing cam 26 with rotation of the pressure releasing cam 26. As a constitution in which the flap-to-be-detected 27 is rotated with the rotation of the pressure releasing cam 26, for example, a constitution in which the rotation shaft is provided with a groove with respect to an axial direction and in which a projection engageable with this groove is provided at a portion contacting the rotation shaft 25 of the pressure releasing cam 26 and the flap-to-be-detected 27 may also be employed. Further, a constitution in which a groove is provided at a portion contacting the rotation shaft 25 of the pressure releasing cam 26 and the flap-to-be-detected 27 and in which a projection engageable with this groove is provided on the rotation shaft 25 may also be employed. By doing so, the flap-to-be-detected 27 rotates with rotation of the pressure releasing cam 26 by rotating the rotation shaft 25.

Figure 4:
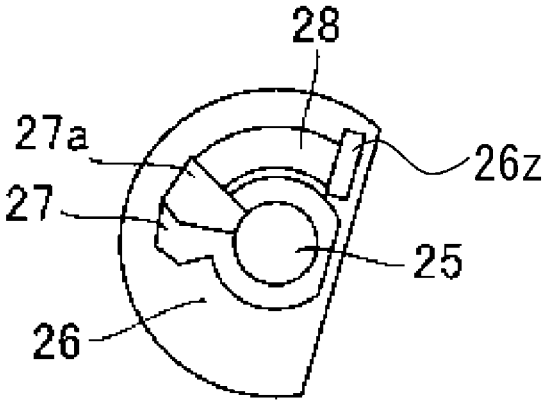
FIG. 4(*a*) and (*b*), i.e., parts (a) and (b) of FIG. 4, are schematic views each showing a phase of a sensor detecting flag relative to a pressure releasing cam in the first embodiment.
Figure 4:
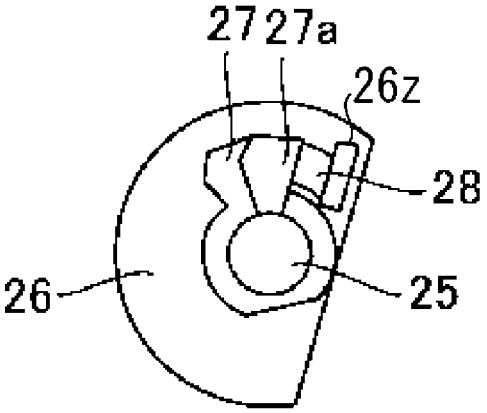

Here, a relative positional relationship between the flap-to-be-detected 27 and the pressure releasing cam 26 will be described with reference to FIG. 4. Part (a) of FIG. 4 is a schematic view showing a relative position (first phase) between the flap-to-be-detected 27 and the pressure releasing cam 26 when the flag spring 28 is expanded. The flag spring 28 is a compression spring and urges the flap-to-be-detected 27 in a direction in which a projected portion 27*a* of the flap-to-be-detected 27 is moved away from a spring bearing surface 26*z* of the pressure releasing cam 26. Part (b) of FIG. 4 is a schematic view showing a relative position (second phase) between the flap-to-be-detected 27 and the pressure releasing cam 26 when the flag spring 28 is contracted. The flag spring 28 is provided between the flap-to-be-detected 27 and the pressure releasing cam 26 as shown in part (a) of FIG. 4. By such a constitution, the flap-to-be-detected 27 is urged by the flag spring 28 functioning as an urging member and is disposed so that a position thereof relative to the pressure releasing cam 26 is a certain position (first phase). In this embodiment, a phase of the flap-to-be-detected 27 relative to the pressure releasing cam 26 when the flag spring 28 is expanded (elongated) is the first phase. To the flap-to-be-detected 27 positioned at the first phase, when a force (force F31 (FIG. 1) described later) with a predetermined magnitude is applied in a direction in which the flag spring 28 is contracted, the position of the flap-to-be-detected 27 relative to the pressure releasing cam 26 is changed from the position of part (a) of FIG. 4 to the position of part (b) of FIG. 4. In this embodiment, a phase of the flap-to-be-detected 27 relative to the pressure releasing cam 26 when the flag spring 28 is contracted is the second phase.

Accordingly, the position of the flap-to-be-detected 27 relative to the pressure releasing cam 26 is changed when a force larger than the urging force of the flag spring 28 applied to the flap-to-be-detected 27 is applied to the flap-to-be-detected 27 in a contraction direction of the flag spring 28. In such a case, the phase of the flap-to-be-detected 27 relative to the pressure releasing cam 26 is changed from the first phase to the second phase. On the other hand, when the force larger than the urging force of the flag spring 28 which has been applied to the flap-to-be-detected 27 in the contraction direction of the flag spring 28 does not act on the flap-to-be-detected 27, the phase of the flap-to-be-detected 27 relative to the pressure releasing cam 26 is changed from the second phase to the first phase.

Figure 17:
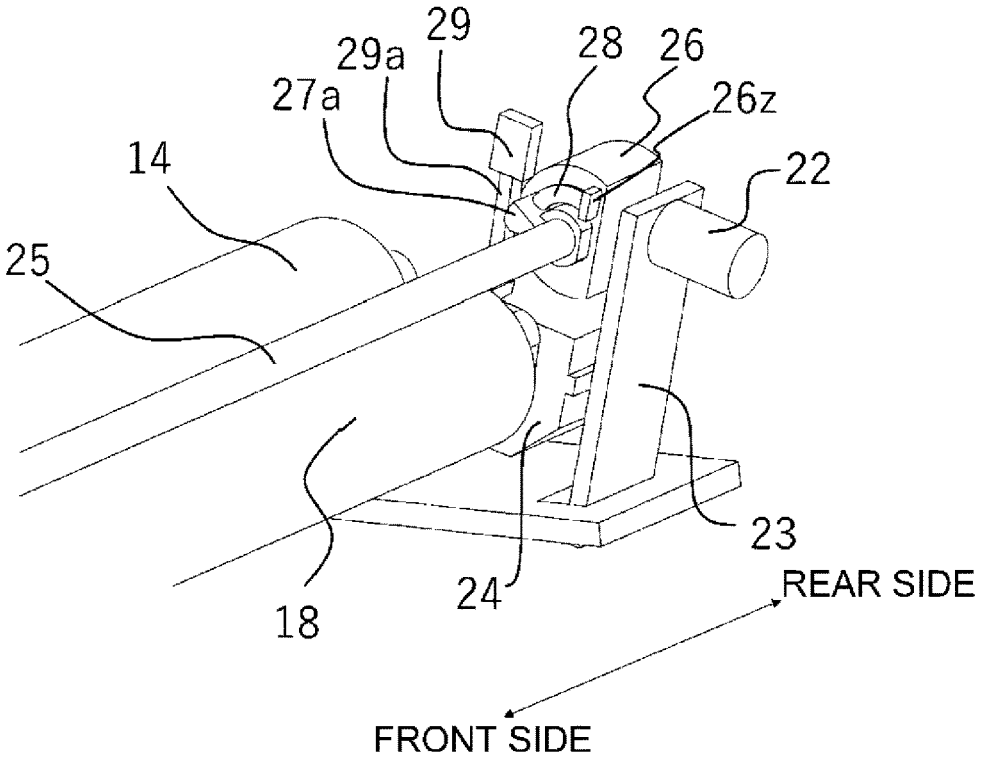
FIG. 17 is a perspective view of FIG. 6.

Returning to FIG. 3, description will be continued. As shown in FIG. 3, on a movement locus of the flap-to-be-detected 27 which is a member-to-be-detected, the lever portion 29*a* is provided. The lever portion 29*a* is a part of the pressure releasing sensor 29 and is an acting (functional) portion movable between a position (contact position) where the lever portion 29*a* acts on the flap-to-be-detected 28 and a position (non-contact position) where the lever portion 29*a* does not act on the flap-to-be-detected 27. The pressure releasing sensor 29 is a sensor provided with a switch for switching ON (first output) and OFF (second output) of a signal to be outputted to the controller 110 (FIG. 5) depending on contact and non-contact between the lever portion 29*a* and the flap-to-be-detected 27 (i.e., a functional (acting)/non-functional (non-acting) state of the flap-to-be-detected 27 relative to the pressure releasing sensor 29). For example, as shown in FIG. 3, in the case where the flap-to-be-detected 27 contacts the lever portion 29*a* and the lever portion 29*a* is in a position shown in FIG. 3, FIG. 6 and FIG. 17 which is a perspective view of FIG. 6, the switch is in an ON state, so that the pressure releasing sensor 29 outputs an ON signal (first output in this embodiment) to the controller 110. At this time, the position of the flap-to-be-detected 27 detected by the pressure releasing sensor 29 is a "detectable position". The detectable position is a "first detection position (first state)" in this embodiment.

Figure 7:
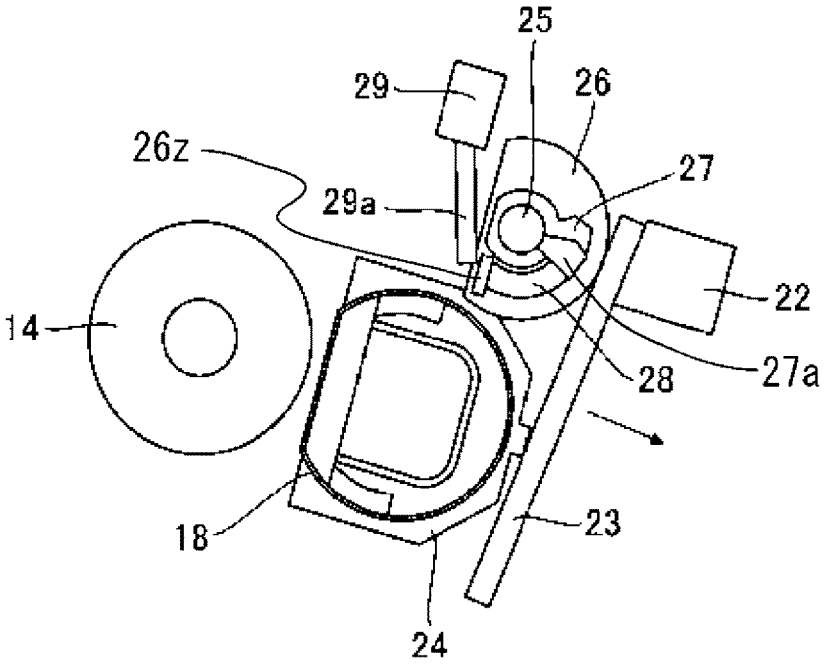
FIG. 7 is a schematic sectional view of the fixing means when the heating unit and the pressing roller in the first embodiment are separated from each other.
Figure 18:
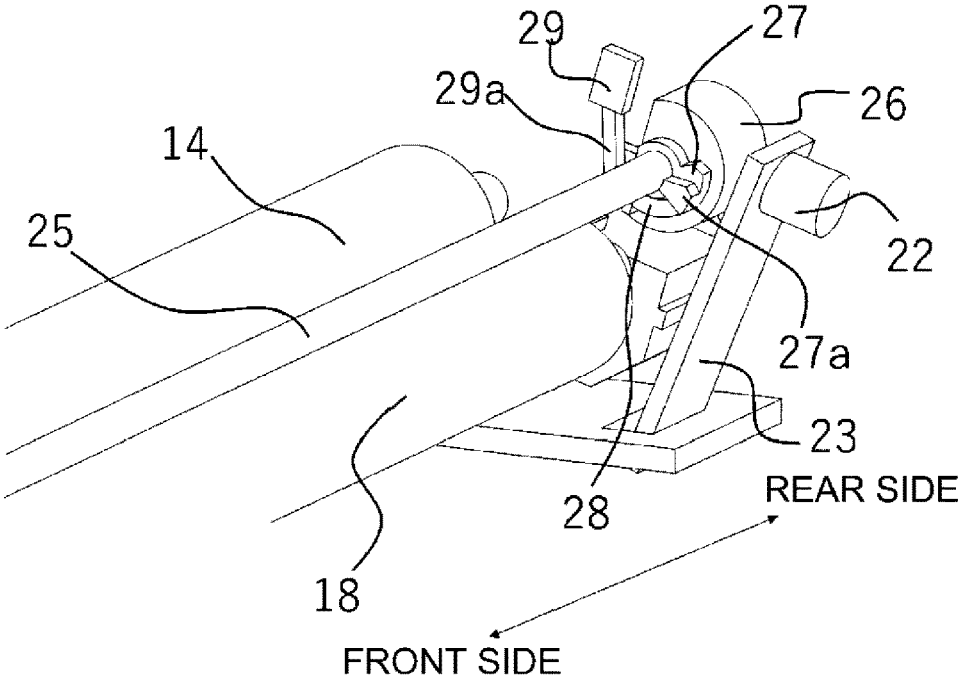
FIG. 18 is a perspective view of FIG. 7.

On the other hand, in the case where the flap-to-be-detected 27 does not contact the lever portion 29*a* and the lever portion 29*a* is in a position shown in FIG. 7 and FIG. 18 which is a perspective view of FIG. 7, the switch is in an OFF state, so that the pressure releasing sensor 29 outputs an OFF signal (second output in this embodiment) to the controller 110. At this time, the position of the flap-to-be-detected 27 which is not detected by the pressure releasing sensor 29 is an "undetectable position". The detectable position is a "second detection position (first state)" in this embodiment. Thus, the "first detection position" and the "second detection position" refer to positions of the flap-to-be-detected 27 when the signal outputted by the pressure releasing sensor 29 is different between the respective positions.

Incidentally, as the pressure releasing sensor 29 other than a sensor of a contact detection type as described above, other sensors, capable of detecting the position of the flap-to-be-detected 27, including an optical sensor such as a photo-interrupter may also be used. Even in the case where other sensors are used, the "first detection position" and the "second detection position" refer to positions of the member-to-be-detected where signals outputted by the sensor are different from each other. For example, in the case where the position where the sensor is capable of detecting the member-to-be-detected is determined in advance, the position of the flap-to-be-detected 27 detected by the sensor is the "first detection position", and the position of the flap-to-be-detected 27 which is not detected by the sensor is the "second detection position".

Figure 5:
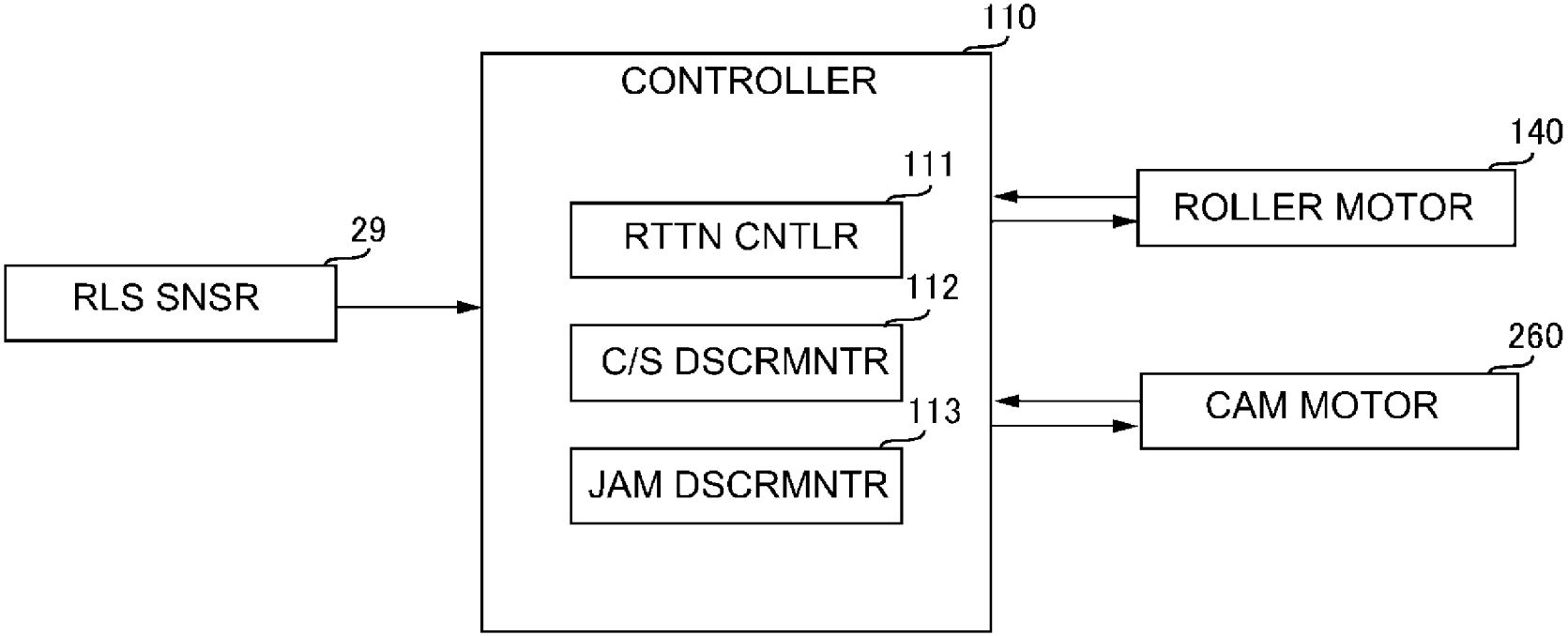
FIG. 5 is a control block diagram showing a functional constitution of a controller in the first embodiment.

Next, a constitution of the controller 110 for controlling an operation of the printer 200 according to this embodiment will be described. FIG. 5 is a control block diagram showing the constitution of the controller 110. The controller 110 which is a control means in this embodiment includes a CPU as a calculating means, a RAM which is a working area when the CPU performs calculation (computation), a ROM in which a program executed by the CPU is stored, and a hardware such as various storing media for storing information. To the controller 110, the ON signal and the OFF signal are inputted from the pressure releasing sensor 29. Further, as shown in FIG. 5, the controller 110 includes a rotation controller 111, a contact/separation discriminating portion 112, and a jam occurrence discriminating portion 113.

The rotation controller 111 controls drive and the number of revolutions (rotational frequency) of a pressing roller rotation motor 140 and a pressure releasing cam rotation motor 260. The contact/separation discriminating portion 112 discriminates, on the basis of information inputted to the controller 110, whether the heating unit 13 and the pressing roller 14 are contacted to each other (pressed state) or separated from each other (pressure-released state). As described above, when the sheet 2 passes through the fixing nip F (during a fixing process), the pressing roller 14 rotates in a contact state with the heating unit 13. Accordingly, a contact/separation operation between the heating unit 13 and the pressing roller 14 is performed before and after the pressing roller 14 rotates, i.e., when the pressing roller 14 does not rotate (when the fixing process is not performed). Therefore, the contact/separation discriminating portion 112 acquires control information of the pressure releasing cam rotation motor 260 and the signal inputted from the pressure releasing sensor 29 when the pressing roller 14 does not rotate. Then, on the basis of acquired information, the contact/separation discriminating portion 112 discriminates whether the heating unit 13 and the pressing roller 14 are contacted to each other or separated from each other (pressed state or pressure-released state).

The jam occurrence discriminating portion 113 discriminates occurrence and non-occurrence of a toner of the sheet 2 on a side downstream of the fixing nip F with respect to the sheet feeding direction on the basis of the information inputted to the controller 110. As described above, by rotation of the pressing roller 14 in contact with the heating unit 13, the sheet 2 passes through the fixing nip F. Accordingly, the jam of the sheet 2 at the fixing nip F is capable of occurring when the pressing roller 14 is in the contact state with the heating unit 13 and the pressing roller 14 rotates. Therefore, the jam occurrence discriminating portion 113 acquires the control information of the pressure releasing cam rotation motor 260 and the signal inputted from the pressure releasing sensor 29 when the pressing roller 14 rotates. Then, on the basis of the acquired information, the contact/separation discriminating portion 112 discriminates the occurrence or non-occurrence of the jam of the sheet 2 in the neighborhood of the fixing nip F.

Figure 6:
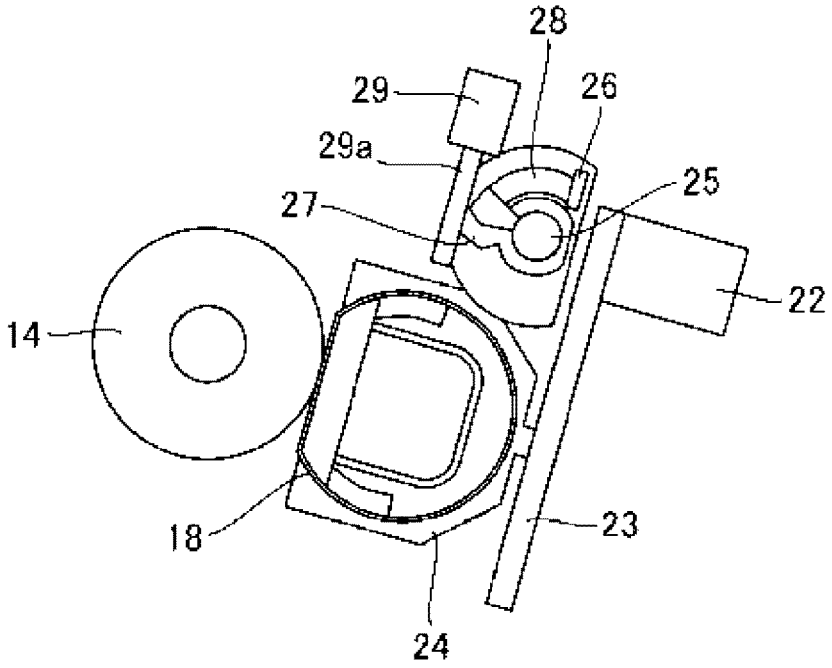
FIG. 6 is a schematic sectional view of the fixing means when a heating unit and a pressing roller in the first embodiment are in contact with each other.
Figure 8:
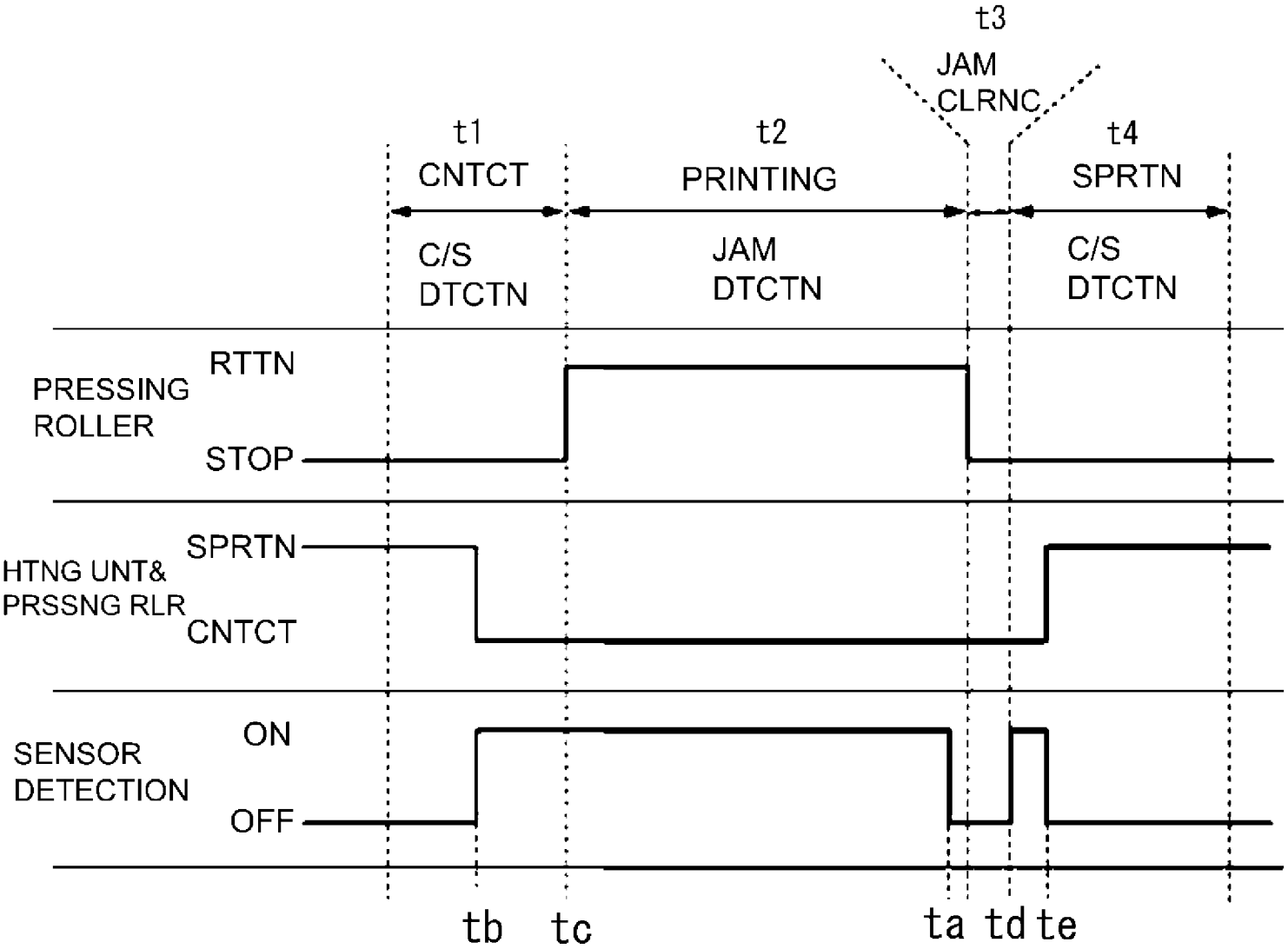
FIG. 8 is a sequence chart showing a detection mode by a pressure releasing sensor in the first embodiment.

Next, with reference to FIGS. 6, 7, 8, 17 and 18, a mode when the sensor unit 100 detects contact/separation between the heating unit 13 and the pressing roller 13 will be described. FIG. 6 is a sectional view of the fixing nip F when the heating unit 13 and the pressing roller 14 are in contact with each other (pressed state). FIG. 7 is a sectional view of the fixing nip F when the heating unit 13 and the pressing roller 14 are moved away (separated) from each other (pressure-released state). FIG. 8 is a timing chart in which the operation of the pressing roller 14, the contact/separation between the heating unit 13 and the pressing roller 14 by the rotation of the pressure releasing cam 26 and the signal inputted from the pressure releasing sensor 29 to the controller 110 are associated with each other.

In the case where the heating unit 13 is contacted to the pressing roller 14 from the separated state from the pressing roller 14 (period t1 in FIG. 8), the pressure releasing cam 26 rotates from a phase (FIG. 7) where the pressure releasing cam 26 contacts the pressing plate 23 to a phase (FIG. 6) where the pressure releasing cam 26 does not contact the pressing plate 23.

The position (phase) of the pressure releasing cam 26 of FIG. 6 is a "non-functional (non-acting) position" relative to the pressing plate 23. The non-functional position is a first position in this embodiment. In the case where the pressure releasing cam 26 is in the non-functional position, as shown in FIG. 6, the lever portion 29*a* of the pressure releasing sensor 29 and the flap-to-be-detected 27 are in a contacted state. Accordingly, the switch of the pressure releasing sensor 29 is in the ON state. At this time, as long as the sheet 2 is not conveyed to the fixing nip F, even when the heating unit 13 and the pressing roller 14 are in the contacted state, there is no need to rotate the pressing roller 14. Accordingly, the controller 110 receives the ON signal outputted from the pressure releasing sensor 29 in general when drive of the pressing roller rotation motor 140 is at rest. Thus, in the case where the drive of the pressing roller rotation motor 140 is at rest and the controller 110 receives the ON signal from the pressure releasing sensor 29, the contact/separation discriminating portion 112 discriminates that the heating unit 13 and the pressing roller 14 are in contact with each other.

On the other hand, from the state shown in FIG. 6, the pressure releasing cam 26 is rotated clockwise by driving the pressure releasing cam rotation motor 260 (FIG. 5), and the pressure releasing cam 26 contacts the pressing plate 23. A position (phase) of the pressure releasing cam 26 is a "functional (acting) position". The functional position is a second position in this embodiment. By further rotation of the pressure releasing cam 26, the spring 22 is contracted, so that the pressing plate 23 is moved in an arrow direction in FIG. 7. Then, the force receiving block 24 is moved in a movement direction of the pressing plate 23, whereby the heating unit 13 is separated from the pressing roller 14 (t4 in FIG. 8). Accordingly, the pressure releasing cam 26 is a part of a mechanism for bringing the heating unit 13 and the pressing roller 14 into contact with each other and for separating the heating unit 13 and the pressing roller 14 from each other. Incidentally, as long as the heating unit 13 and the pressing roller 14 are in non-contact with each other, the sheet 2 is not conveyed to the fixing nip F, and therefore, the pressing roller 14 does not rotate.

When the pressure releasing cam 26 is rotated so that the pressing spring 22 is contracted, as shown in FIG. 7, a state in which the lever portion 29*a* of the pressure releasing sensor 29 and the flap-to-be-detected 27 are in non-contact with each other is formed. At this time, the switch of the pressure releasing sensor 29 is in the OFF state, and therefore, to the controller 110, the OFF signal outputted from the pressure releasing sensor 29 is inputted. Accordingly, the controller 110 receives the OFF signal outputted from the pressure releasing sensor 29 when the pressing roller rotation motor 140 is in a rotation stop state. Thus, in the case where drive of the pressing roller rotation motor 140 is at rest and the controller 110 receives the OFF signal from the pressure releasing sensor 29, the contact/discriminating portion 112 discriminates that the heating unit 13 and the pressing roller 14 were separated from each other. Incidentally, in the states of FIG. 6 and FIG. 7, to the flag spring 28, the force toward the contraction direction of the flag spring 28 is not applied. Thus, when the force toward the contraction direction of the flag spring 28 is not applied to the flag spring 28, the phase of the flap-to-be-detected 27 relative to the pressure releasing cam 26 is the first phase.

Figure 9:
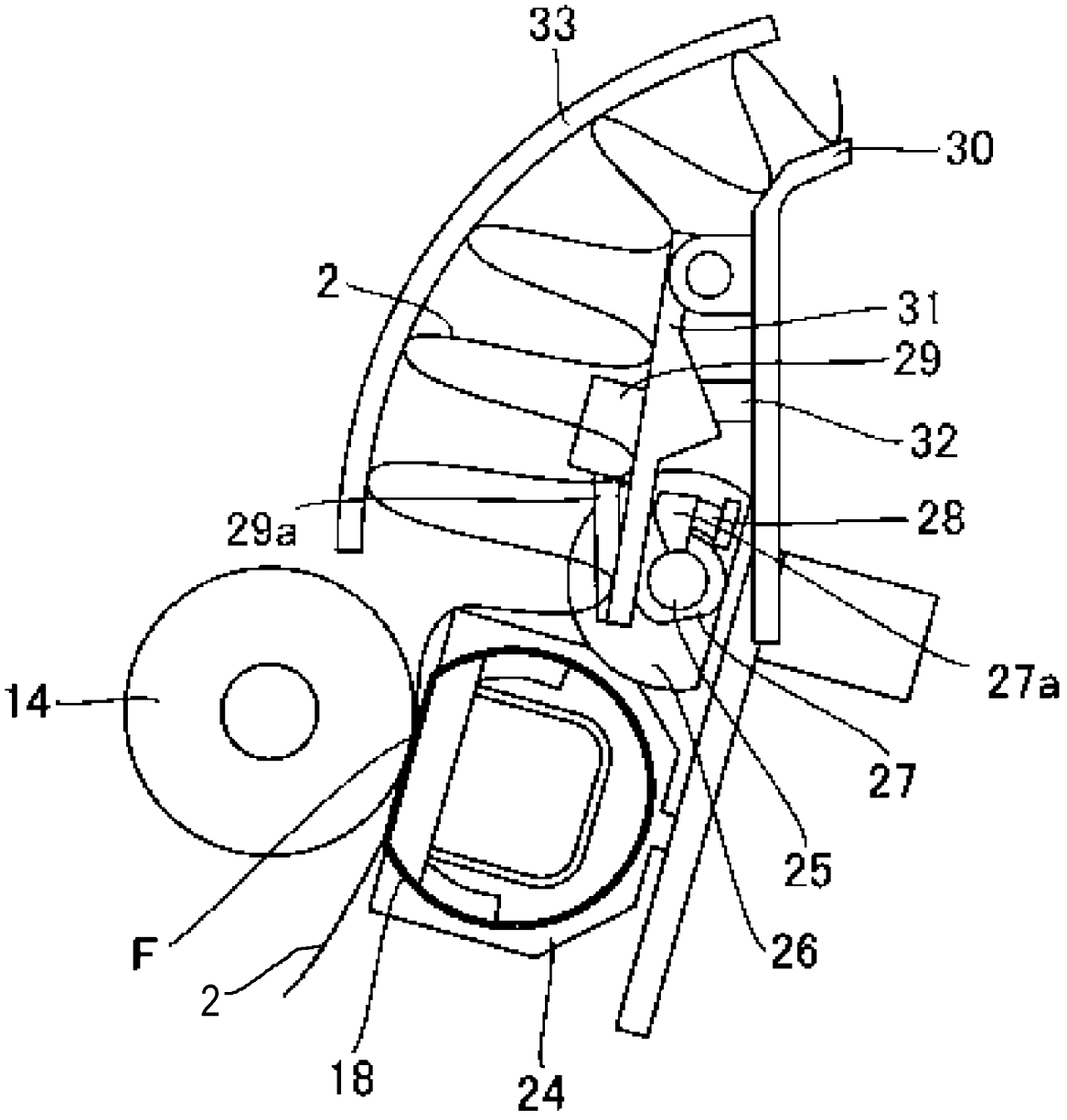
FIG. 9 is a schematic sectional view of a neighborhood of the fixing nip during jam detection in the first embodiment.
Figure 19:
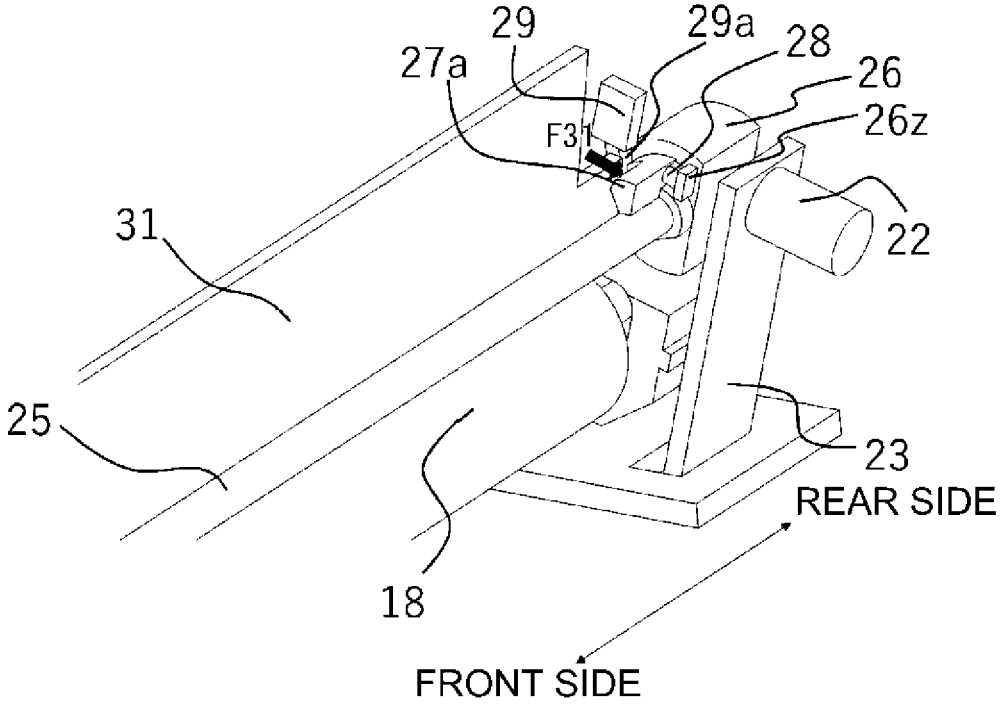
FIG. 19 is a perspective view of FIG. 9.

Then, with reference to FIGS. 3, 9 and 19, a mode when the sensor unit 100 detects the jam of the sheet 2 has occurred in the fixing nip F will be described. FIG. 3 is, as has already been described above, the sectional view of the fixing nip F in the state in which the sensor unit 100 is provided. FIGS. 9 and 19 are a sectional view and a perspective view, respectively, of the fixing nip F during detection of the jam of the sheet 2. Incidentally, in FIG. 9, the sectional view when the jam occurred in the neighborhood of the fixing nip F on a downstream side of the feeding direction of the sheet 2 is shown. From the heating unit 13 and the pressing roller 14 toward the downstream side of the feeding direction of the sheet 2, a heating-side feeding guide 30 and a pressing-side feeding guide 33, which are guiding members for guiding the sheet 2 during feeding, are provided. Further, the heating-side feeding guide 30 is provided with a detection guide 31 so as to contact the sheet 2. The detection guide 31 is urged by a holding spring 32 in a direction of moving toward the pressing-side feeding guide 33 so that the detection guide 31 is in a predetermined attitude relative to the heating-side feeding guide 30 and is a second movable member provided so as to be movable in contact with the sheet 2.

Here, arrangement of respective portions with respect to a direction perpendicular to the feeding direction of the sheet 2, i.e., a widthwise direction of the sheet 2 will be described. As shown in FIG. 19, the detection guide 31 is a board member provided from a front side to a rear side, i.e., over the widthwise direction of the sheet 2 so as to contact the sheet 2. The detection guide 31 is to disposed so that a projected portion 27*a* of the flap-to-be-detected 27 is contactable to the detection guide 31 on a rear side of the detection guide 31. The projected portion 27*a* is provided so as to project from a main body portion in an axial (shaft) direction of the rotation shaft 25 when a portion of the flap-to-be-detected 27 contacting the pressure releasing cam 26 is the main body of the flap-to-be-detected 27. Further, the rear side of the projected portion 27*a* is formed integrally with the flap-to-be-detected 27, so that a rear-side portion of the flap-to-be-detected 27 contacts the lever portion 29*a*. In addition, the lever portion 29*a* is disposed in a place where the lever portion 29*a* does not contact the sheet 2 fed between the detection guide 31 and the pressing-side feeding guide 33.

Here, it is assumed that in a period t2 of FIG. 8, i.e., during feeding of the sheet 2 by rotating the pressing roller 14 in the contacted state to the heating unit 13, the jam of the sheet 2 has occurred in a region ranging from the fixing nip F to a position downstream of the fixing nip F with respect to the sheet feeding direction. Incidentally, in FIG. 8, a jam occurrence timing is represented by ta. When the jam of the sheet 2 occurs, the sheet 2 stagnates in a bellows shape between the detection guide 31 and the pressing-side feeding guide 33 by being continuously fed. At this time, a space between the detection guide 31 and the pressing-side feeding guide 33 is extended by the bent (bellows-shaped) sheet 2. Then, when an extending force of the sheet 2 exerted on the detection guide 31 becomes larger than a force of urging the detection guide 31 by the holding spring 32, the detection guide 31 moves toward the heating-side feeding guide 30. When the detection guide 31 further moves toward the heating-side feeding guide 30, the detection guide 31 contacts the projected portion 27*a* of the flap-to-be-detected 27, so that the projected portion 27*a* is pressed with a force F31 (FIG. 19) by the detection guide 31.

At this time, the detection guide 31 presses the projected portion 27*a* in a direction opposite to a direction in which the urging force of the flag spring 28 is applied to the flap-to-be-detected 27. Therefore, when the force F31 with which the detection guide 31 presses the projected portion 27*a* becomes larger than the urging force of the flag spring 28 against the flap-to-be-detected 27, the flap-to-be-detected 27 rotates clockwise, i.e., in the contraction direction of the flag spring 28. Here, a position of the detection guide 31 when the detection guide 31 is not extended by the sheet 2 is a "guiding position", and a position of the detection guide 31 when the detection guide 31 is extended and presses the projected portion 27*a* is an "urging position". The "guiding position" is a third position in this embodiment, and the "urging position" is a fourth position in this embodiment. Further, in this case, a direction in which the detection guide 31 moves between the guiding position and the pressing position is a "guide movement direction". The guide movement direction is a second direction in this embodiment.

By rotation of the flap-to-be-detected 27 in the clockwise direction, the phase of the flap-to-be-detected 27 relative to the pressure releasing cam 26 is changed from the first phase to the second phase. Further, as shown by the timing to in FIG. 8, by rotation of the flap-to-be-detected 27 in the clockwise direction, the flap-to-be-detected 27 is moved away from the lever portion 29*a* of the pressure releasing sensor 29. For this reason, the switch of the pressure releasing sensor 29 is switched from the ON state to the OFF state. Accordingly, when the pressing roller rotation motor 140 is in the driving state, the signal inputted from the pressure releasing sensor 29 to the controller 110 is switched from the ON signal to the OFF signal. Thus, in the case where the pressing roller rotation motor 140 is driven and the signal inputted from the pressure releasing sensor 29 is switched from the ON signal to the OFF signal, the jam occurrence discriminating portion 113 discriminates that the jam has occurred in a region from the fixing nip F toward the downstream side of the sheet feeding direction.

Thus, when the pressure releasing cam 26 is in the first position and the detection guide 31 is moved by being pressed by the jammed sheet to the fourth position different from the third position, the flap-to-be-detected 27 is moved by being pressed by the detection guide 31 to the second phase different from the first phase. As a result, the functional/non-functional state (acting/non-acting state) of the flap-to-be-detected 27 relative to the lever portion 29*a* of the pressure releasing sensor 29 is changed from the first state to the second state, so that the output of the pressure releasing sensor 29 is changed from ON to OFF. By this change in signal, the jam occurrence discriminating portion 113 is capable of discriminating that the jam occurred.

It is assumed that after the jam of the sheet 2 has occurred, the jammed sheet 2 is removed by a user at timing of a period t3 of FIG. 8. When the jammed sheet 2 is removed, the space between the detection guide 31 and the pressing-side feeding guide 33 is returned to a state before the jam occurrence, i.e., is returned from the state of FIG. 9 to the state of FIG. 3.

Correspondingly, the detection guide 31 is moved so as to be separated from the heating-side feeding guide 30, i.e., is moved from the pressing position to the guiding position (from the fourth position to the third position). When the detection guide 31 is moved from the pressing position to the guiding position, the detection guide 31 is in the state in which the detection guide 31 does not guide the projected portion 27*a*, and therefore, the phase of the flap-to-be-detected 27 relative to the pressure releasing cam 26 is changed from the second phase to the first phase. Accordingly, when the jammed sheet 2 is removed by the user after the jam occurrence, the signal inputted from the pressure releasing sensor 29 to the controller 110 is switched from the OFF signal to the ON signal.

Thus, in the case where, after the jam is detected, the signal inputted from the pressure releasing sensor 29 is changed from the OFF signal to the ON signal, the jam occurrence discriminating portion 113 discriminates that the jam of the sheet 2 that occurred in the region ranging from the fixing nip F to the position downstream of the fixing nip F with respect to the feeding direction of the sheet 2 was cleared (eliminated). Then, when the pressure releasing cam 26 is subsequently rotated (is switched from the pressed state to the pressure-released state), the state in which the lever portion 29*a* of the pressure releasing sensor 29 and the flap-to-be-detected 27 are in non-contact with each other is formed. As a result, as shown in the period t4 of FIG. 8, the signal inputted from the pressure releasing sensor 29 to the controller 110 is switched from the ON signal to the OFF signal.

On the other hand, as long as the jammed sheet 2 is not removed after the jam is detected, the state in which the projected portion 27*a* is pressed by the detection guide 31 is continued. Accordingly, in the case where after the jam is detected, the signal inputted from the pressure releasing sensor 29 is kept in the OFF signal state, the jam occurrence discriminating portion 113 discriminates that the jam in the neighborhood of the fixing nip F is not eliminated. Thus, in this embodiment, on the basis of the sensor signal of the pressure releasing sensor 29 and the driving state of the pressing roller 14, the occurrence or non-occurrence of the jam of the sheet 2 in the printer 200 and the contact or separation between the pressing roller 14 and the heating unit 13 can be detected.

Here, for example, the case of assuming that sensors, such as a sensor for detecting the contact or separation between the pressing roller and the heating unit and a sensor for detecting the jam of the sheet, for detecting behaviors for respective members constituting the printer are provided will be considered. In such a case, a space for providing a sensor for detecting a movement amount of a mechanism for permitting contact and separation between the pressing roller and the heating unit and a sensor for detecting the sheet jam in the neighborhood of the fixing nip is required to be ensured inside a casing of the printer. Therefore, upsizing of the printer cannot be avoided. Further, problems such that costs of sensors themselves for detecting behaviors of members constituting the printer and costs for maintaining the sensors are increased can arise.

Therefore, in this embodiment, as described above, on the basis of a detection result, the contact or separation between the heating unit 13 and the pressing roller 14 and the occurrence or non-occurrence of the jam of the sheet 2 in the neighborhood of the fixing nip F are discriminated. As a result, the number of sensors to be mounted in the printer 200 can be made small, so that the cost relating to the sensor can be reduced.

Figure 10:
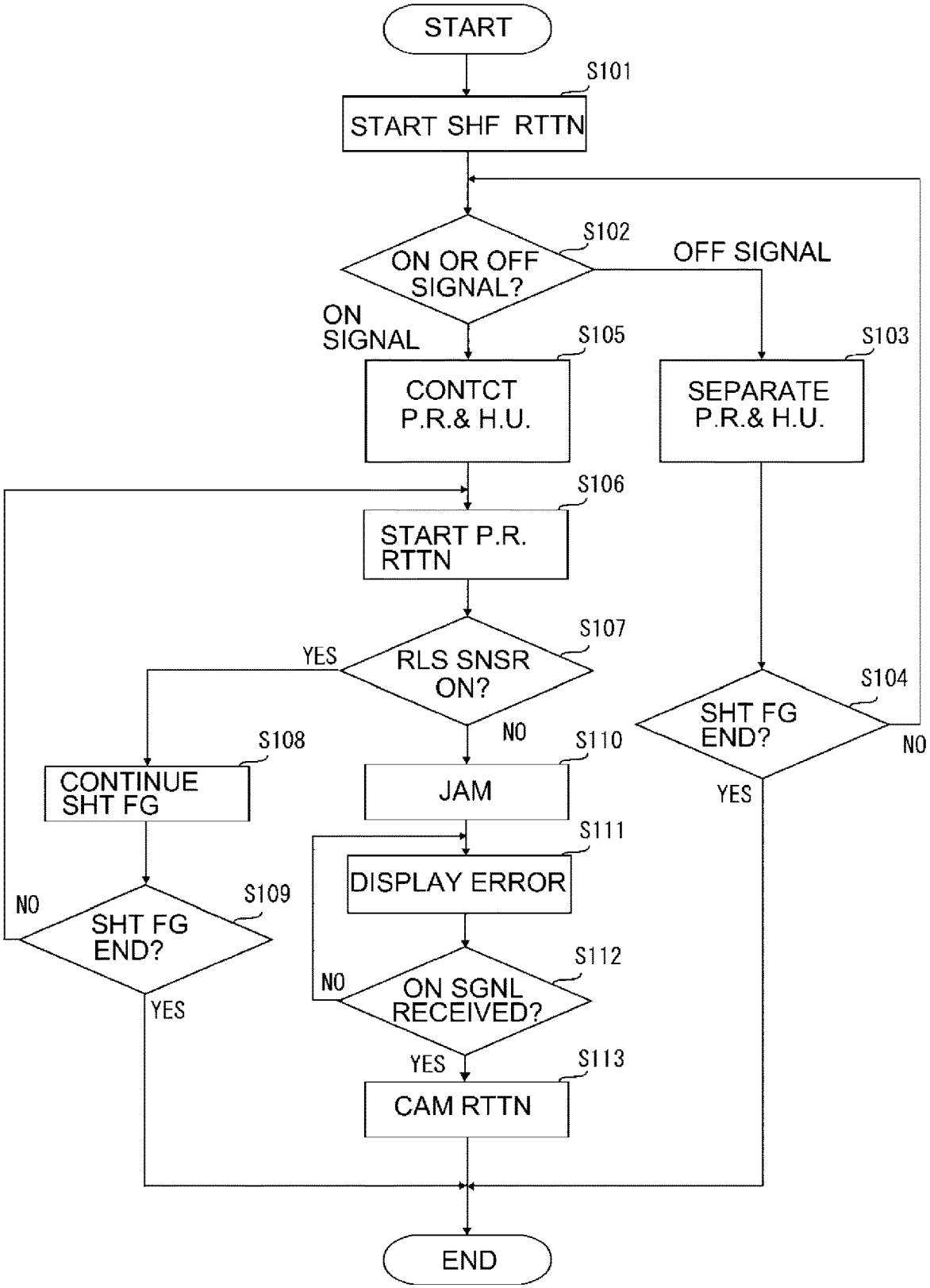
FIG. 10 is a flowchart showing a flow of a process of discriminating contact and separation between the heating unit and the pressing roller and occurrence and non-occurrence of a jam in the neighborhood of the fixing nip in the first embodiment.

Next, a flow of a process of discriminating the contact or separation between the heating unit 13 and the pressing roller 14 and discriminating the occurrence or non-occurrence of the jam of the sheet 2 in the neighborhood of the fixing nip F in this embodiment will be described. FIG. 10 is a flowchart showing the flow of the process of discriminating the contact or separation between the heating unit 13 and the pressing roller 14 and discriminating the occurrence or non-occurrence of the jam of the sheet 2 in the neighborhood of the fixing nip F in the controller 110.

As described with reference to FIG. 1, the sheet 2 on which the toner images are transferred at the transfer nip T is fed to the fixing nip F formed by the heating unit 13 and the pressing roller 14. Accordingly, as long as the image is not formed on the sheet 2, there is no need that the heating unit 13 and the pressing roller 14 are contacted to each other. Therefore, in this embodiment, a print job is carried out, so that the image is formed on the sheet 2 in the image forming portion 210 and then the flow of this process is started using passing of the sheet 2 through the image forming portion 210 as a trigger.

Incidentally, depending on the feeding passage of the sheet 2, i.e., a distance from the image forming portion 210 to the fixing nip F, detection of a state, in which the sheet 2 is fed toward the fixing nip F, by an unshown sensor provided in the feeding passage of the sheet 2 may also be used as a trigger. In this embodiment, the following description will be made using, as the trigger, formation of the image on the sheet 2 in the image forming portion 210. When the sheet 2 passes through the image forming portion 210, the rotation controller 111 causes the pressure releasing cam rotation motor 260 to start drive (S101). Timing when the rotation controller 111 causes the pressure releasing cam rotation motor 260 to start drive is represented by timing tb in FIG. 8.

When the pressure releasing cam rotation motor 260 is driven, the pressure releasing cam 26 is rotated about the rotation shaft 25. A movement direction of the pressure releasing cam 26 about the rotation shaft 25 is a "cam rotational direction". The cam rotational direction is a first direction in this embodiment. At this time, the contact/separation discriminating portion 112 discriminates the contact or separation between the heating unit 13 and the pressing roller 14 on the basis of the sensor signal inputted from the pressure releasing sensor 29 (S102). In the case where the OFF signal is inputted from the pressure releasing sensor 29 (S102/OFF signal), the contact/separation discriminating portion 112 discriminates that the heating unit 13 and the pressing roller 14 are separated from each other (S103). The controller 110 discriminates that the heating unit 13 and the pressing roller 14 are in a separated state, and in the case where the sheet 2 is discharged on a sheet discharge/stack table 17 (S104/YES), this process is ended. On the other hand, in the case where the contact/separation discriminating portion 112 discriminates that the heating unit 13 and the pressing roller 14 are in the separated state and the sheet 2 is not discharged on the sheet discharge/stack table 17 (S104/NO), the controller 110 executes the same process again from S102.

In the process of S102, in the case where the ON signal is inputted from the pressure releasing sensor 29 (S102/ON signal), the contact/separation discriminating portion 112 discriminates that the heating unit 13 and the pressing roller 14 are in a contacted state (S105). When the heating unit 13 and the pressing roller 14 are in the contacted state, the toner image can be fixed on the sheet 2 in the fixing nip F. Accordingly, when discrimination that the heating unit 13 and the pressing roller 14 are in the contacted state is made, the rotation controller 111 causes the pressing roller rotation motor 140 to start drive (S106). Timing when the rotation controller 111 causes the pressing roller rotation motor 140 to start the drive is represented by timing tc in FIG. 8. By rotating the pressing roller 14, the sheet 2 is fed through the fixing nip F. During rotation of the pressing roller 41, the jam occurrence discriminating portion 113 discriminates, on the basis of the sensor signal inputted from the pressure releasing sensor 29, whether or not the jam of the sheet 2 occurred in a region from the fixing nip F to the downstream side of the feeding direction of the sheet 2 (S107).

In the case where the signal inputted from the pressure releasing sensor 29 is the ON signal (S107/YES), the jam occurrence discriminating portion 113 discriminates that the jam of the sheet 2 does not occur in the region from the fixing nip F to the downstream side of the sheet feeding direction. When the discrimination that the jam of the sheet 2 does not occur is made by the jam control discriminating portion 113, the controller 110 causes the fixing unit 220 to continue feeding of the sheet 2 (S108). Then, the controller 110 executes the same process again from S106 (S109/NO) until the sheet 2 is discharged on the sheet discharge/stack table 17 (S109/YES). In the case where the signal inputted from the pressure releasing sensor 29 is OFF signal (S107/NO), the jam occurrence discriminating portion 113 discriminates that the jam of the sheet 2 occurs in the region from the fixing nip F to the downstream side of the sheet feeding direction (S110). In FIG. 8, the jam occurs at timing ta.

When discrimination that the jam occurred is made by the jam occurrence discriminating portion 113, the rotation controller 111 causes the detection guide roller rotation motor 140 to stop the drive. When the discrimination that the jam occurred is made, the controller 110 causes an unshown operation display portion mounted on the printer 200 to display an error screen showing that the jam occurred in the region from the fixing nip F to the position on the downstream side of the sheet feeding direction (S111). The user makes reference to the error screen displayed at the operation display portion and performs an operation for removing the jammed sheet 2. However, a part of the jammed sheet 2 remains in some instances. The jam occurrence discriminating portion 113 discriminates, on the basis of the sensor signal inputted from the pressure releasing sensor 29, whether or not the jam of the sheet S is eliminated (cleared) after a lapse of a predetermined time from the discrimination that the jam occurred (S112). Incidentally, timing when the user performs an operation on the operation display portion after the user removes the jammed sheet 2 may also be set at a time after a lapse of the predetermined time from the discrimination that the jam occurred.

After the jam occurrence, as long as the jammed sheet 2 is not removed, the signal inputted from the pressure releasing sensor 29 is kept at the OFF signal. On the other hand, when the jammed sheet 2 is removed, the signal inputted from the pressure releasing sensor 29 to the controller 110 is switched from the OFF signal to the ON signal. In the case where the controller 110 receives the OFF signal from the pressure releasing sensor 29 (S112/NO), the jam occurrence discriminating portion 113 discriminates that the jam occurring in the neighborhood of the fixing nip F is not eliminated. In the case where discrimination that the jam is not eliminated, the controller 110 executes the same process again from S111. In the case where the controller 110 receives the ON signal from the pressure releasing sensor 29 (S112/YES), the jam occurrence discriminating portion 113 discriminates that the jam occurring in the neighborhood of the fixing nip F is eliminated. When discrimination that the jam occurring in the neighborhood of the fixing nip F is eliminated is made, the controller 110 sends a signal for driving the pressure releasing cam rotation motor 260 to the rotation controller 111, so that the pressure releasing cam 26 is rotated (S113).

At the timing ta, although the heating unit 13 and the pressing roller 14 are in contact with each other, a state in which the OFF signal is inputted from the pressure releasing sensor 29 to the controller 110 is formed. Then, by removing the jammed sheet 2, the ON signal is inputted from the pressure releasing sensor 29 to the controller 110. Timing when the jammed sheet 2 is removed and the ON signal is inputted from the pressure releasing sensor 29 to the controller 110 is timing td in FIG. 8. At the timing td in FIG. 8, the pressing roller 14 is at rest and the signal of the pressure releasing cam 29 is kept at the ON signal, i.e., the state between the heating unit 13 and the pressing roller 14 is kept in the contacted state. Accordingly, although there is no sheet to be fed to the fixing nip F, the state in which the heating unit 13 and the pressing roller 14 are in contact with each other is formed.

In S113, the controller 110 causes the rotation controller 111 to drive the pressure releasing cam rotation motor 260 until the OFF signal is inputted from the pressure releasing sensor 29 to the controller 110, i.e., until the heating unit 13 and the pressing roller 14 are separated from each other, and then ends this process. In this case, the rotation controller 111 drives the pressure releasing cam rotation motor 260 until the timing reaches timing to in FIG. 8. As described above, in this embodiment, on the basis of a detection result of the pressure releasing sensor 29, detection of the contact or separation between the heating unit 13 and the pressing roller 14 and detection of the occurrence of the jam in the region from the fixing nip F to the downstream side of the sheet feeding direction are enabled. As a result, a sensor constitution of the printer 200 can be simplified, and in addition, a cost can be reduced.

Second Embodiment

In the first embodiment, description of the sensor unit 100 capable of detecting the contact and separation between the heating unit 13 and the pressing roller 14 and detecting the jam occurring in the region from the fixing nip F to the downstream side of the sheet feeding direction was made. In this embodiment, a constitution of a sensor unit 300 (FIG. 12) for detecting an open/close state of a rear door portion 37 which is an outer casing member provided to the frame of the printer 200 and for detecting the jam occurring in the region from the fixing nip F to the position of the downstream side of the feeding direction of the sheet 2 will be described. Incidentally, the structure of the printer 200 is the same as that of the first embodiment. Further, constituent elements which are the same as those in the first embodiment are represented by the same reference numerals or symbols and redundant description will be described.

Figure 11:
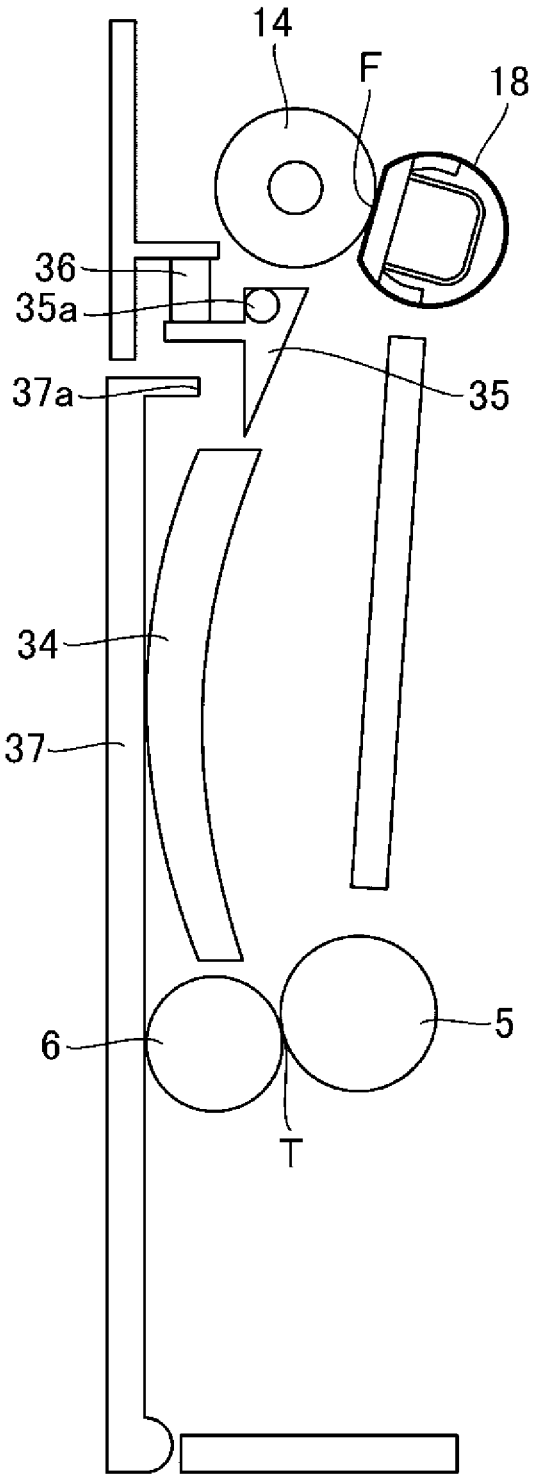
FIG. 11 is a schematic sectional view showing a sheet feeding passage from a transfer nip to a fixing nip in a second embodiment.

First, a constitution of a feeding passage of the sheet 2 from the transfer nip T to the fixing nip F will be described. FIG. 11 is a sectional view of the feeding passage of the sheet 2 from the transfer nip T to the fixing nip F. The sheet 2 on which an image is formed in the image forming portion 210 is fed from the transfer nip T between the inner belt driving roller 5 and the secondary transfer roller 6 toward the fixing nip F between the heating unit 13 and the pressing roller 14. As guiding members for guiding the sheet 2, a transfer feeding guide 34 and a nip entrance guide 35 are provided. The sheet 2 discharged from the transfer nip T is fed along the transfer feeding guide 34 toward the nip entrance guide 35 in a guided state, and thereafter, the sheet 2 is guided by the nip entrance guide 35 and enters the fixing nip F.

The transfer feeding guide 34 is provided between a feeding place of the sheet 2 and the rear door portion 37 provided so as to openable and closable relative the frame of the printer 200. Further, the transfer feeding guide 34 is configured to be openable toward an outside of the frame of the printer 200. By such a constitution, for example, when the jam of the sheet 2 occurs, by opening the rear door portion 37 and thereafter by opening the transfer feeding guide 34, the sheet 2 stagnating in the neighborhood of the transfer feeding guide 34 can be removed. The nip entrance guide 35 which is a second movable member in this embodiment is provided so as to be rotatable about a rotation center 35*a*. The nip entrance guide 35 is urged to a position where the sheet 2 is guided toward the fixing nip F by a guide holding spring 36 provided in the frame of the printer 200. The guide holding spring 36 is set at a spring pressure capable of holding the nip entrance guide 35 when the sheet 2 is fed in a normal state, i.e., when the sheet 2 is fed from the transfer feeding guide 34 in a state in which the sheet 2 is bent in a bellows shape.

Figure 12:
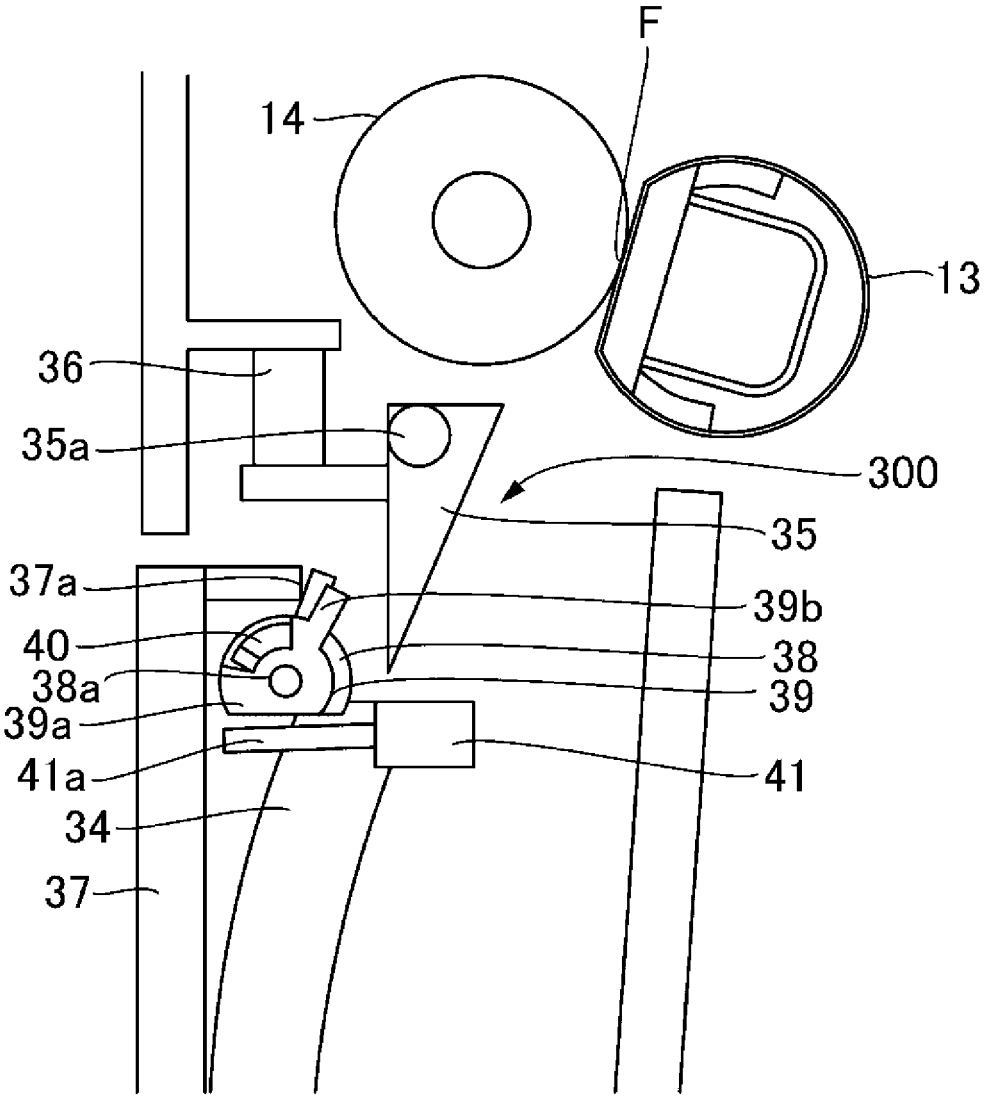
FIG. 12 is a schematic sectional view of a neighborhood of a fixing nip during closure of a rear door portion in the second embodiment.

Next, the constitution of the sensor unit 300 according to this embodiment will be described. FIG. 12 is a sectional view of the fixing nip F to which the sensor unit 300 according to this embodiment is provided adjacent. FIG. 12 shows a cross-section when the rear door portion 37 is in a closed state. The sensor unit 300 includes a rotatable member (first movable member) 38, a flap-to-be-detected (member-to-be-detected) 39, a flag spring (urging member) 40, a rear door sensor 41, a lever portion 41*a*, and the nip entrance guide (second movable member) 35. As shown in FIG. 12, the rotatable member 38 is provided between the transfer feeding guide 34 and the rear door portion 37. FIG. 12 also shows a state when the sheet 2 is normally fed (conveyed) along the nip entrance guide 35.

The rear door portion 37 is provided with a rotatable member pressing (urging) portion 37*a*. When the rear door portion 37 is closed, the rotatable member pressing portion 37*a* presses (urges) the rotatable member 38 and moves the rotatable member 38 to a first position shown in FIG. 12. On the other hand, when the rear door portion 37 is opened, the rotatable member pressing portion 37*a* is separated from the rotatable member 38, so that the rotatable member 38 is rotated to a second position shown in FIG. 15. The rotatable member 38 which is a first movable member in this embodiment is provided with the flap-to-be-detected 39. The flap-to-be-detected 39 is supported by the rotatable member 38 in a mechanical play state toward a rotational direction of the rotatable member 38 with a shaft 38*a*, as a center, when the rotatable member 38 rotates. The rotational direction of the rotatable member 38 about the shaft 38*a* is a first direction in this embodiment. By this play, the flap-to-be-detected 39 is movable relative to the rotatable member 38 and is capable of moving to at least two positions (first phase and a second phase).

Further, the flap-to-be-detected 39 is provided movably with rotation of the rotatable member 38 while maintaining the phase thereof relative to the rotatable member 38 by an urging force of the flag spring 40. As a constitution in which the flap-to-be-detected 39 is movable with the rotation of the rotatable member 38, for example, a constitution in which the shaft of the rotatable member 38 is provided with a groove with respect to an axial direction and in which a projection engageable with this groove is provided at a portion where the rotatable member 38, the flap-to-be-detected 39 and the shaft 38*a* contact each other may also be employed. Further, a constitution in which a groove is provided at a portion where the rotatable member 38, the flap-to-be-detected 39 contact each other and in which a projection engageable with this groove is provided on the shaft 38*a* may also be employed. By doing so, the flap-to-be-detected 39 moves with rotation of the rotatable member 38.

Further, the flap-to-be-detected 39 is provided with a first projected portion 39*a* and a second projected portion 39*b* so as to project to an outside in the axial direction at different positions with respect to a circumferential direction. By the projection provided so as to extend in the axial direction of the shaft 38*a* of the rotatable member 38, the first projected portion 39*a* is pressed, whereby the flap-to-be-detected 39 is moved with rotation of the rotatable member 38. Further, when the sensor unit 300 is seen in a direction shown in FIG. 12, the shaft 38*a* is provided with an unshown urging member for urging the rotatable member 38 so as to rotate the rotatable member 38 counterclockwise. When the rear door portion 37 is opened by this urging member, the rotatable member 38 rotates counterclockwise. Further, with rotation of the rotatable member 38, the flap-to-be-detected 39 is also rotated.

Figure 13:
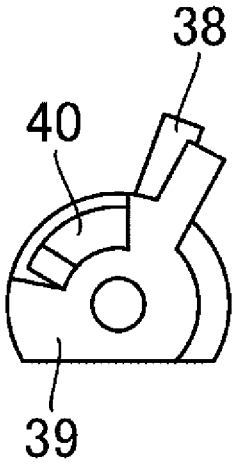
FIG. 13(*a*) and (*b*), i.e., parts (a) and (b) of FIG. 13, are schematic views each showing a phase of a flag-to-be-detected relative to a rotatable member in the second embodiment.
Figure 13:
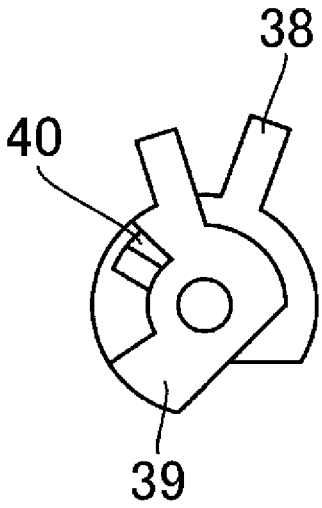

Here, a relative positional relationship between the flap-to-be-detected 39 and the rotatable member 38 will be described with reference to FIG. 13. Part (a) of FIG. 13 is a schematic view showing a relative position between the flap-to-be-detected 39 and the rotatable member 38 when the flag spring 40 is expanded. Part (b) of FIG. 13 is a schematic view showing a relative position between the flap-to-be-detected 39 and the rotatable member 38 when the flag spring 40 is contracted. The flag spring 40 which is an urging member in this embodiment is provided between the flap-to-be-detected 39 and the rotatable member 38 as shown in part (a) of FIG. 13. By such a constitution, the flap-to-be-detected 39 is urged by the flag spring 40 functioning as the urging member and is disposed so that a position thereof relative to the rotatable member 38 is a certain position (first phase). In this embodiment, a phase of the flap-to-be-detected 39 relative to the rotatable member 38 when the flag spring 40 is expanded (elongated) is the first phase. To the flap-to-be-detected 39 positioned at the first phase, when a force with a predetermined magnitude is applied in a direction in which the flag spring 40 is contracted, the position of the flap-to-be-detected 39 relative to the rotatable member 38 is changed from the position of part (a) of FIG. 13 to the position (second phase) of part (b) of FIG. 13. In this embodiment, a phase of the flap-to-be-detected 39 relative to the rotatable member 38 when the flag spring 40 is contracted is the second phase.

Accordingly, the position of the flap-to-be-detected 39 relative to the rotatable member 38 is changed when a force larger than the urging force of the flag spring 40 applied to the flap-to-be-detected 39 is applied to the flap-to-be-detected 39 in a contraction direction of the flag spring 40. In such a case, the phase of the flap-to-be-detected 39 relative to the rotatable member 38 is changed from the first phase to the second phase. On the other hand, when the force larger than the urging force of the flag spring 28 which has been applied to the flap-to-be-detected 39 in the contraction direction of the flag spring 40 does not act on the flap-to-be-detected 39, the phase of the flap-to-be-detected 39 relative to the rotatable member 38 is changed from the second phase to the first phase.

Returning to FIG. 12, description will be continued. As shown in FIG. 12, on a movement locus of the flap-to-be-detected 39 which is a member-to-be-detected in this embodiment, the lever portion 41*a* of the rear door sensor 41 is provided. The rear door sensor 41 is a sensor provided with a switch for switching ON and OFF of a signal to be outputted to the controller 120 (FIG. 14) depending on contact and non-contact between the lever portion 41*a* and the flap-to-be-detected 39. For example, as shown in FIG. 12, in the case where the flap-to-be-detected 39 does not contact the lever portion 41*a*, the switch is in an OFF state, so that the rear door sensor 41 outputs an OFF signal (first output in this embodiment) to the controller 120. The position of the flap-to-be-detected 39 which is not detected by the rear door sensor 41 is an "undetectable position". The undetectable position is a "first detection position (first state)" in this embodiment.

On the other hand, in the case where the flap-to-be-detected 39 contacts the lever portion 41*a*, the switch is in an ON state, so that the rear door sensor 41 outputs an ON signal (second output in this embodiment) to the controller 120. The position of the flap-to-be-detected 27 detected by the rear door sensor 41 is a "detectable position". The detectable position is a "second detection position (first state)" in this embodiment.

Incidentally, as the rear door sensor 41 other than a sensor of a contact detection type as described above, other sensors, capable of detecting the position of the flap-to-be-detected 39, including an optical sensor such as a photo-interrupter may also be used. Even in the case where other sensors are used, the "first detection position" and the "second detection position" refer to positions of the member-to-be-detected where signals outputted by the sensor are different from each other. For example, in the case where the position where the sensor is capable of detecting the member-to-be-detected is determined in advance, the position of the flap-to-be-detected 39 which is not detected by the sensor is the "first detection position", and the position of the flap-to-be-detected 39 detected by the sensor is the "second detection position".

Figure 14:
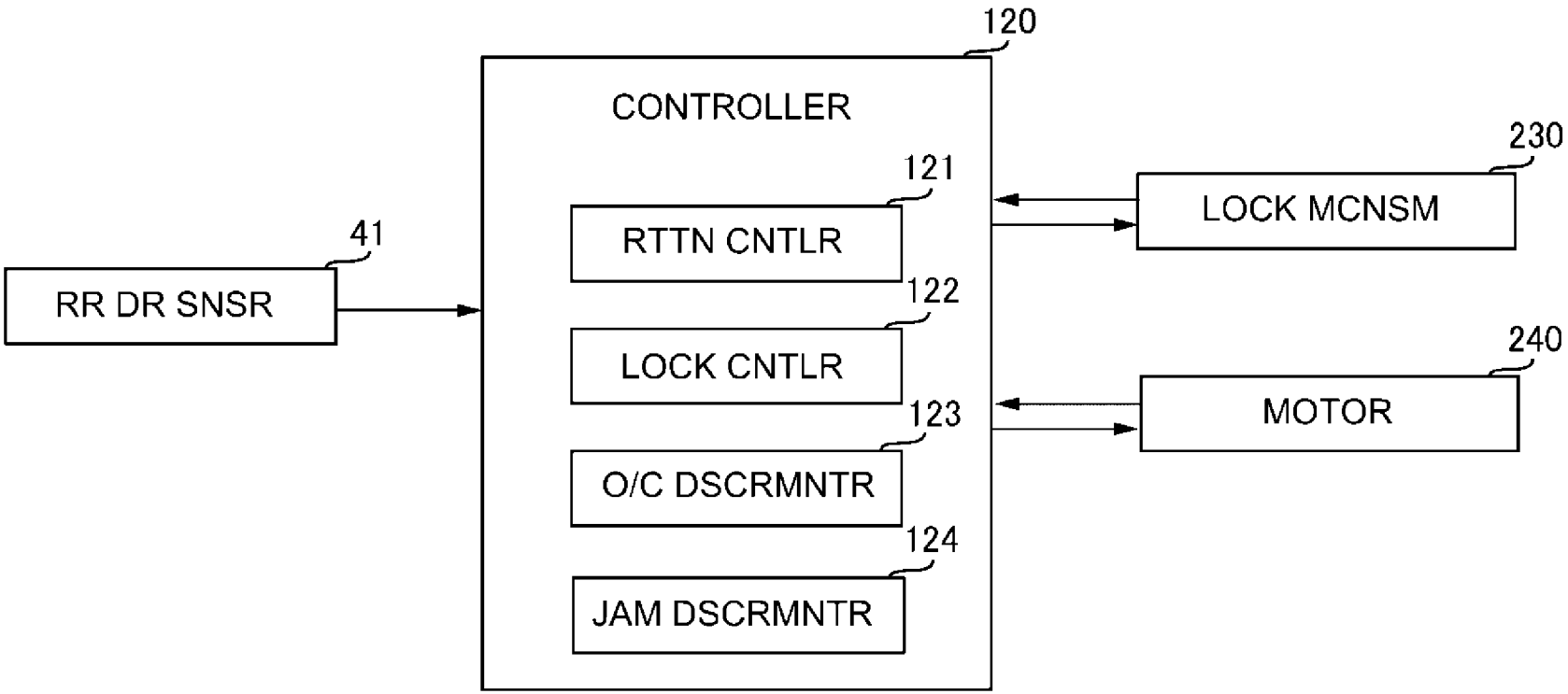
FIG. 14 is a control block diagram showing a functional constitution of a controller in the second embodiment.

Next, a constitution of the controller 120 for controlling an operation of the printer 200 according to this embodiment will be described. FIG. 14 is a control block diagram showing the constitution of the controller 120. The controller 120 which is a control means in this embodiment is constituted by including a CPU as a calculating means, a RAM which is a working area when the CPU performs calculation (computation), a ROM in which a program executed by the CPU is stored, and a hardware such as various storing media for storing information. To the controller 120, the ON signal and the OFF signal are inputted from the rear door sensor 41. Further, as shown in FIG. 14, the controller 120 includes a rotation controller 121, a locking mechanism controller 122, an open/close discriminating portion 123, and a jam occurrence discriminating portion 124. The rotation controller 121 controls drive of a motor 240 for rotating, of rollers for feeding the sheet 2, rollers using the motor as a driving source, for example, the inner driving roller 5 and the pressing roller 14.

The locking mechanism controller 122 controls a locking mechanism 230 and thus controls opening and closing of the rear door portion 37. The locking mechanism 230 is a mechanism for maintaining the rear door portion 37 in a closed state. The locking mechanism controller 122 turns on the locking mechanism 230 when the motor 240 is driven by the rotation controller 121, and thus restricts movement of the rear door portion 37 so that the rear door portion 37 does not open. The open/close discriminating portion 123 discriminates, on the basis of information inputted to the controller 120, whether the state of the rear door portion 37 relative to the frame of the printer 200 is an open state or the closed state. When the motor 240 is driven, the rear door portion 37 is closed by the locking mechanism 230, so that the movement of the rear door portion 37 is restricted. Accordingly, an opening/closing operation of the rear door portion 37 is performed when the motor 240 is not driven, i.e., when the sheet 2 is not fed. Therefore, the open/close discriminating portion 123 acquires the signal inputted from the rear door sensor 41 when the locking mechanism 230 is in an OFF state, and discriminates whether the state of the rear door portion 37 relative to the frame of the printer 200 is the open state or the closed state.

The jam occurrence discriminating portion 124 discriminates occurrence and non-occurrence of a toner of the sheet 2 on a side upstream of the fixing nip F with respect to the sheet feeding direction on the basis of the information inputted to the controller 120. The sheet 2 is fed toward the fixing nip F when the motor 240 is driven. At this time, the locking mechanism 230 is turned on by the locking mechanism controller 122, so that movement of the rear door portion 37 is restricted while the rear door portion 37 is kept in the closed state. Therefore, when the motor 240 is in a driven state, the jam occurrence discriminating portion 124 acquires the signal inputted from the rear door sensor 41 and discriminates the occurrence or non-occurrence of the jam of the sheet 2 on a side upstream of the fixing nip F with respect to the sheet feeding direction.

Figure 15:
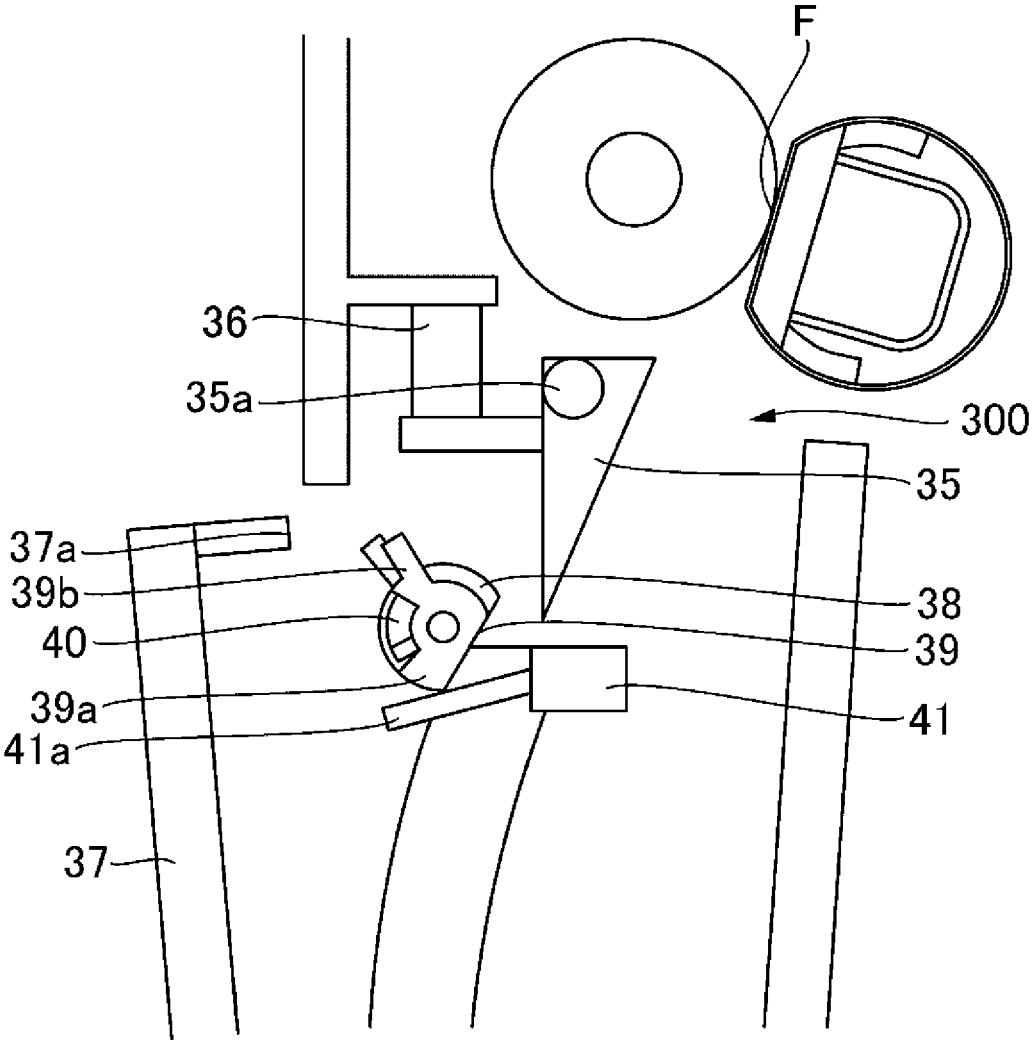
FIG. 15 is a schematic sectional view of the neighborhood of the fixing nip during opening of the rear door portion in the second embodiment.

Next, with reference to FIGS. 12 and 15, a mode when the sensor unit 300 detects an open/close state of the rear door portion 37 will be described, FIG. 12 is a sectional view of the fixing nip F when the rear door portion 37 is in the closed state as described above. FIG. 15 is a sectional view of the fixing nip F when the rear door portion 37 is in the open state. Incidentally, in FIG. 15, a cross-section of the fixing nip F when the motor 50 is not driven, i.e., when the sheet 2 is not fed is shown. FIG. 12 is also a schematic view when the motor 50 is driven and the sheet is normally fed along the nip entrance guide 35.

In the case where the rear door portion 37 is closed, as shown in FIG. 12, the rotatable member 38 is positioned so that the flap-to-be-detected 39 is in a phase where the flap-to-be-detected 39 does not contact the lever portion 41*a*. The position of the rotatable member at this time is a "door close position". The position of the rotatable member 38 located in the door close position is a "first position". In the case where the rotatable member 38 is in the door close position, as shown in FIG. 12, the lever portion 41*a* of the rear door sensor 41 and the flap-to-be-detected 39 are in a separated state. Accordingly, a switch of the rear door sensor 41 is in an OFF state, so that the rear door sensor 41 outputs an OFF signal (first output in this embodiment).

On the other hand, in the case where the rear door portion 37 is open, as shown in FIG. 15, the rotatable member 38 rotates so that the flap-to-be-detected 39 contacts the lever portion 41*a*. The position of the rotatable member at this time is a "door open position". The position of the rotatable member 38 located in the door open position is a "second position". Incidentally, in the case where the rotatable member 38 is in the door open position, as shown in FIG. 15, the lever portion 41*a* of the rear door sensor 41 and the flap-to-be-detected 39 are in a contacted state. Accordingly, a switch of the rear door sensor 41 is in an ON state. As described above, FIG. 15 illustrates the fixing nip F when the sheet 2 is not fed, and therefore, shows a state in which the rotation controller 121 causes the motor 240 to stop drive. At this time, the locking mechanism 230 is in an OFF state. In the case where the motor 240 is in a drive stop state and the controller receives an ON signal (second output in this embodiment) from the rear door sensor 41, the open/close discriminating portion 123 discriminates that the rear door portion 37 is in the open state. Incidentally, at this time, to the flap-to-be-detected 39, a force such as a force toward the contraction direction of the flag spring 40 is not applied. That is, the flap-to-be-detected 39 is positioned at the first phase relative to the rotatable member 38.

Figure 16:
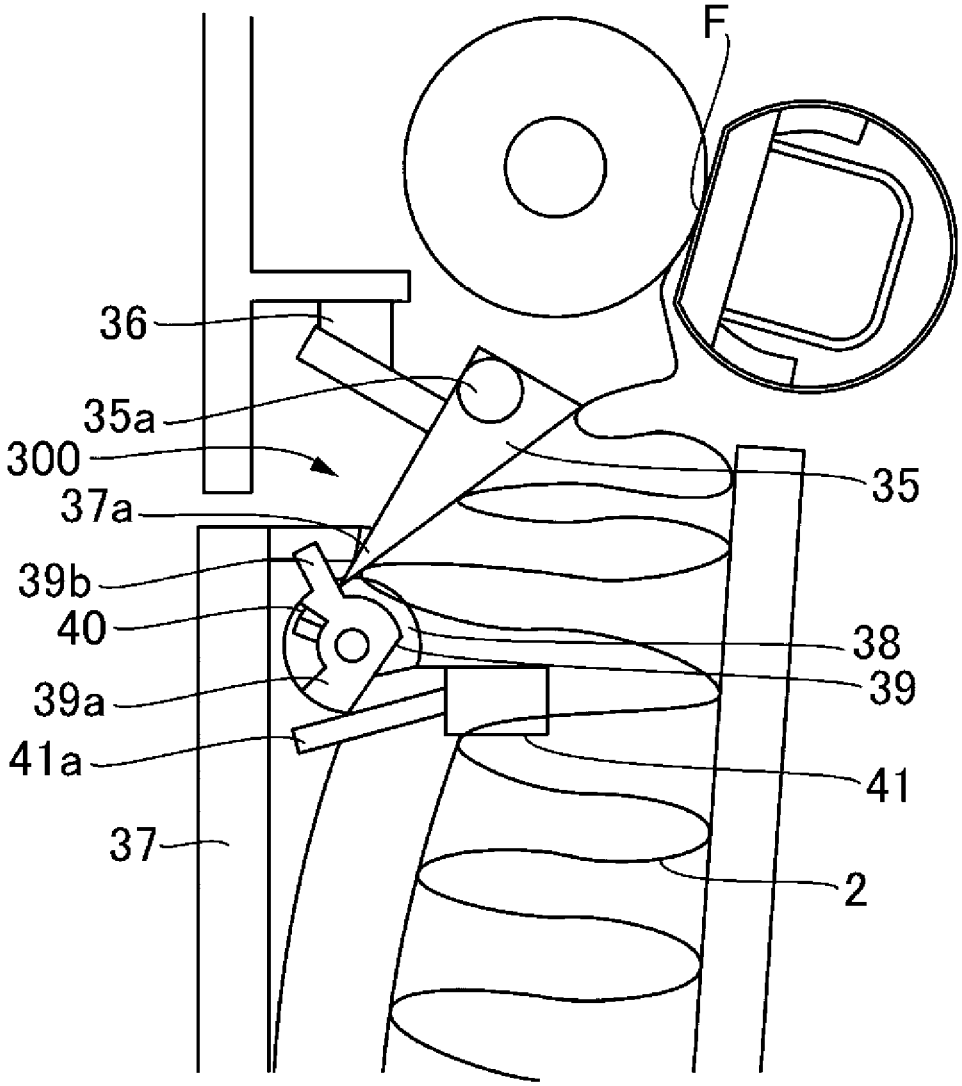
FIG. 16 is a schematic sectional view of the neighborhood of the fixing nip during jam detection in the second embodiment.

Then, with reference to FIGS. 12 and 16, a mode when the sensor unit 300 detects the jam of the sheet 2 has occurred in the fixing nip F will be described. FIG. 12 is the sectional view of the fixing nip F when the sheet 2 is fed. FIG. 16 is a sectional view of the fixing nip F during detection of the jam of the sheet 2. Incidentally, in FIG. 16, the sectional view when the jam occurred in the neighborhood of the fixing nip F on an upstream side of the feeding direction of the sheet 2 is shown.

As described above, from the fixing nip F toward the upstream side of the sheet feeding direction, the transfer feeding guide 34 and the nip entrance guide 35 are provided. The nip entrance guide 35 is provided so as to be contactable to the second projected portion 39*b* when the guide holding spring 36 moves so as to contract.

As shown in FIG. 16, when the jam of the sheet 2 occurs, the sheet 2 stagnates in a bellows shape by being continuously fed. Then, when an extending force of the jammed sheet 2 exerted on the nip entrance guide 35 becomes larger than a force of urging the nip entrance guide 35 by the holding spring 36, the nip entrance guide 35 moves toward the rear door portion 37.

At this time, the nip entrance guide 35 presses the second projected portion 39*b* in a direction opposite to a direction in which the urging force of the flag spring 40 is applied to the flap-to-be-detected 27. As a result, the flap-to-be-detected 39 rotates, relative to the rotatable member 38, counterclockwise, i.e., in the contraction direction of the flag spring 40. Here, a position of the nip entrance guide 35 when the nip entrance guide 35 is not extended by the sheet 2 is a "guiding position", and a position of the detection guide 31 when the nip entrance guide 35 is extended and presses the second projected portion 39*b* is an "urging position". The "guiding position" is a third position in this embodiment, and the "urging position" is a fourth position in this embodiment. Further, in this case, a direction in which the nip entrance guide 35 moves between the guiding position and the pressing position is a "guide movement direction". The guide movement direction is a second direction in this embodiment.

By rotation of the flap-to-be-detected 39 in the counterclockwise direction, the phase of flap-to-be-detected 39 relative to the rotatable member 38 is changed from the first phase to the second phase. Further, by rotation of the flap-to-be-detected 39 in the counterclockwise direction, the flap-to-be-detected 39 contacts the lever portion 41*a* of the rear door sensor 41, and therefore, the switch of the rear door sensor 41 is switched from the OFF state to the ON state. FIG. 16 shows the fixing nip F when the sheet 2 is fed, and therefore, the rotation controller 121 is in a state in which the rotation controller 121 drives the motor 50. At this time, the locking mechanism 230 is in an ON state.

Accordingly, when the motor 240 rotates, the signal inputted from the rear door sensor 41 to the controller 120 is switched from the OFF signal to the ON signal. Thus, in the case where the motor 240 is in a rotation state and the signal inputted from the rear door sensor 41 is switched from the OFF signal to the ON signal, the jam occurrence discriminating portion 124 discriminates that the jam occurred in a region from the fixing nip F to the upstream side of the sheet feeding direction.

It is assumed that after the jam of the sheet 2 has occurred, the jammed sheet 2 is removed by opening the rear door portion 37 and the transfer feeding guide 34. When the jammed sheet 2 is removed, the nip entrance guide 35 is returned to a state before the jam occurrence, i.e., is returned from the state of FIG. 16 to the state of FIG. 12. Correspondingly, the nip entrance guide 35 is moved so as to be separated from the rear door portion 41, i.e., is moved from the pressing position to the guiding position (from the fourth position to the third position). When the nip entrance guide 35 is moved from the pressing position to the guiding position, the nip entrance guide 35 is in the state in which the nip entrance guide 35 does not guide the second projected portion 39*b*, and therefore, the phase of the flap-to-be-detected 39 relative to the rotatable member 38 is changed from the second phase to the first phase. Accordingly, when the jammed sheet 2 is removed by the user after the jam occurrence, the signal inputted from the rear door sensor 41 to the controller 120 is switched from the ON signal to the OFF signal.

Thus, in the case where after the jam is detected, the signal inputted from the rear door sensor 41 is changed from the ON signal to the OFF signal, the jam occurrence discriminating portion 124 discriminates that the jam of the sheet 2 that occurred in the region from the fixing nip F to the position upstream of the fixing nip F with respect to the feeding direction of the sheet 2 was cleared (eliminated).

On the other hand, as long as the jammed sheet 2 is not removed after the jam is detected, the state in which the second projected portion 39*b* is pressed by the nip entrance guide 35 is continued. Accordingly, in the case where after the jam is detected, the signal inputted from the rear door sensor 41 is kept in the ON signal state, the jam occurrence discriminating portion 124 discriminates that the jam in the neighborhood of the fixing nip F is not eliminated. Thus, in this embodiment, on the basis of the sensor signal of the rear door sensor 41 and the driving state of the motor 240, the occurrence or non-occurrence of the jam of the sheet 2 in the printer 200 and the open or close state of the rear door portion 37 can be detected.

Other Embodiment

In the first embodiment, a plurality of behaviors of the printer 200 in the neighborhood of the fixing nip F were detected. Other than the fixing nip F, for example, in other nips in the printer 200 such as nips between the primary transfer units 10Y, 10M, 10C and 10K and the photosensitive drums 7Y, 7M, 7C and 7K, behaviors such as contact/separation between the primary transfer unit and the photosensitive drum may also be detected.

Further, when the member-to-be-detected is an openable member provided to the frame of the printer 200, the open/close state of the openable member can be detected similarly as in the case of the rear door portion 37.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2019-032128 filed on Feb. 25, 2019, and 2020-20190 filed on Feb. 7, 2020, which are hereby incorporated by reference herein in their entirety.

What is claimed is:

1. A sensor unit for detecting a jam of a sheet, comprising:

a rotatable first movable member;

a sensor configured to detect a position of said first movable member; and a second movable member having a guiding function of guiding movement of the sheet, wherein said first movable member includes a member-to-be-detected configured to be detected by said sensor and an urging to member configured to urge said member-to-be-detected toward a position in which a phase of said member-to-be-detected relative to said first movable member is a first phase, wherein when the sheet is normally fed along said second movable member, said first movable member is in a first position, said member-to-be-detected is in the first phase, said second movable member is in a third position, and a functional/non-functional state of said member-to-be-detected relative to said sensor is one of functional and non-functional states, wherein when the sheet is not fed and said first movable member is in a second position different in rotational direction from the first position, said member-to-be-detected is in the first phase, said second movable member is in the third position, and the functional/non-functional state of said member-to-be-detected relative to said sensor is the other of the functional and non-functional states, and wherein when said first movable member is in the first position and said second movable member is moved to a fourth position different from the third position by being pushed by a jammed sheet, by movement of said member-to-be-detected to a second phase different from the first phase through pushing thereof by said second movable member, the functional/non-functional state of said member-to-be-detected relative to said sensor is changed from the one state to the other state and an output of said sensor changes.

2. A sensor unit according to claim 1, wherein when the sheet is normally fed along said second movable member, the output of said sensor is a first output, wherein when the sheet is not fed and said first movable member is in the second position, the output of said sensor is a second output different from the first output, and wherein when said second movable member moves from the third position to the fourth position, the output of said sensor changes from the first output to the second output.

3. An image forming apparatus for forming an image on a sheet, comprising:

an image forming portion configured to form the image on the sheet; and a sensor unit configured to detect a jam of the sheet, said sensor unit comprising:

a rotatable first movable member, a sensor configured to detect a position of said first movable member, and a second movable member having a guiding function of guiding movement of the sheet, wherein said first movable member includes a member-to-be-detected configured to be detected by said sensor and an urging member configured to urge said member-to-be-detected toward a position in which a phase of said member-to-be-detected relative to said first movable member is a first phase, wherein when the sheet is normally fed along said second movable member, said first movable member is in a first position, said member-to-be-detected is in the first phase, said second movable member is in a third position, and a functional/non-functional state of said member-to-be-detected relative to said sensor is one of functional and non-functional states, wherein when the sheet is not fed and said first movable member is in a second position different in rotational direction from the first position, said member-to-be-detected is in the first phase, said second movable member is in the third position, and the functional/non-functional state of said member-to-be-detected relative to said sensor is the other of the functional and non-functional states, and wherein when said first movable member is in the first position and said second movable member is moved to a fourth position different from the third position by being pushed by a jammed sheet, by movement of said member-to-be-detected to a second phase different from the first phase through pushing thereof by said second movable member, the functional/non-functional state of said member-to-be-detected relative to said sensor is changed from the one state to the other state and an output of said sensor changes.

4. An image forming apparatus according to claim 3, further comprising a fixing unit configured to fix the image on the sheet, wherein said fixing unit includes first and second nip forming members configured to form a fixing nip in which the sheet carrying the image is nipped and fed and includes a pressure releasing cam configured to release pressure applied to the fixing nip, wherein said first movable member is said pressure releasing cam, and wherein the first position is a position at which pressure during a fixing process is applied to the fixing nip, and the second position is a position at which the pressure during the fixing process is released.

5. An image forming apparatus according to claim 3, further comprising a door provided openable relative to a frame of said image forming apparatus, wherein said first movable member is said door, and wherein the first position is a position at which said door is closed relative to said frame of said image forming apparatus, and the second position is a position at which said door is open relative to said frame of said image forming apparatus.

6. An image forming apparatus according to claim 5, further comprising:

a fixing unit configured to fix the image on the sheet, and a guide configured to guide the sheet to said fixing unit, wherein said second movable member is said guide.

* * * * *